US006644629B1

(12) United States Patent
Higashi et al.

(10) Patent No.: US 6,644,629 B1
(45) Date of Patent: Nov. 11, 2003

(54) OVERWINDING PREVENTION DEVICE FOR WINCH

(75) Inventors: Shinobu Higashi, Niihari-gun (JP); Kazuhisa Ishida, Tsuchiura (JP); Kouji Funato, Niihari-gun (JP); Toshimi Sakai, Niihari-gun (JP); Masami Ochiai, Niihari-gun (JP); Teruo Igarashi, Higashiibaraki-gun (JP); Akira Nakayama, Tsuchiura (JP); Tsutomu Udagawa, Niihari-gun (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 09/807,460

(22) PCT Filed: Oct. 14, 1999

(86) PCT No.: PCT/JP99/05672

§ 371 (c)(1),
(2), (4) Date: May 1, 2001

(87) PCT Pub. No.: WO00/21868

PCT Pub. Date: Apr. 20, 2000

Related U.S. Application Data

(60) Provisional application No. 60/108,080, filed on Nov. 12, 1998.

(30) Foreign Application Priority Data

Oct. 14, 1998 (JP) ..... 10/291976

(51) Int. Cl.[7] ..... B66D 1/08
(52) U.S. Cl. ..... 254/361
(58) Field of Search ..... 254/267, 276, 254/360, 361

(56) References Cited

U.S. PATENT DOCUMENTS

| | | | |
|---|---|---|---|
| 4,187,681 | A | 2/1980 | Johnson |
| 5,342,020 | A | 8/1994 | Stone |

FOREIGN PATENT DOCUMENTS

| | | |
|---|---|---|
| DE | A 24 23 542 | 2/1976 |
| EP | A1 0 130 750 | 1/1985 |
| GB | A 2 101 952 | 1/1983 |
| JP | A 62-235193 | 10/1987 |
| JP | A 8-91772 | 4/1996 |
| JP | A 8-259182 | 10/1996 |
| JP | A 8-290894 | 11/1996 |
| JP | A 9-175784 | 7/1997 |
| JP | Y2 2552639 | 7/1997 |
| WO | WO 96/09979 | 4/1996 |

*Primary Examiner*—Emmanuel Marcelo
(74) *Attorney, Agent, or Firm*—Oliff & Berridge, PLC

(57) ABSTRACT

A winch over-winding prevention apparatus includes: a winch drum that is driven for up/down hoist in response to a command issued through an operating lever; a stop switch that is activated when a suspended object raised or lowered as a hoisting cable wound around the winch drum is further taken up or fed out is hoisted up to a predetermined stop position; and a stop device that stops drive of the winch drum when the stop switch is activated, and further includes: a speed detection device that detects a hoist speed of the suspended object; a speed reduction device that reduces a drive speed of the winch drum once the suspended object reaches a predetermined speed reduction start position; and a speed reduction control device that calculates a deceleration rate of the winch drum in correspondence to the hoist speed of the suspended object detected by the speed detection device and controls drive of the speed reduction device in response to a speed reduction command corresponding to the deceleration rate.

12 Claims, 20 Drawing Sheets

OVERWINDING PREVENTION DEVICE FOR WINCH

This application claims the benefit of Provisional application No. 60/108,080, filed Nov. 12, 1998.

The disclosure of Japanese Patent Application No. H10-291976 filed Oct. 14, 1998 is herein incorporated by reference.

TECHNICAL FIELD

The present invention relates to a winch over-winding prevention apparatus that stops the upward hoisting motion of a suspended object such as a hook in the operation of, for instance, a crane operation machine.

BACKGROUND ART

Hook over-winding prevention apparatuses in the prior art that stop the drive of a winch by detecting an over-wind of a hook include that disclosed in Japanese Utility Model Registration No. 2552639. This over-winding prevention apparatus is provided with a stop switch, which is turned on when the hook is wound up by a distance equal to or more than a specific distance, at the front end of the boom and unloads hydraulic fluid from the hydraulic pump as the stop switch is turned on. The supply of the pressure oil from the hydraulic pump to the hydraulic motor is suspended, to stop the drive of the winch.

Today, winches are driven at higher speeds than ever before, and thus, there arises a problem in that when the hook over-winding prevention apparatus operates during a fast upward hoisting operation, the suspended object, such as a hook, swings upward due to its inertial force, to result in damage to parts caused by the impact load applied to a supporting member such as a boom by the swinging object, which may even come into contact with the front end of the boom. In order to prevent the hook from coming into contact with the boom during a fast upward hoisting operation, it is necessary to provide the stop switch at a position that is lower than the boom front end to anticipate the upward swing of the suspended object. In such a case, however, the operating range of the hoist operation becomes limited.

In order to address this problem, the apparatus disclosed in the publication mentioned above is further provided with a speed limiting switch at a position lower than that of the stop switch to limit the quantity of hydraulic fluid supplied from the hydraulic pump to the hydraulic motor by reducing the area of the oil passage for the hydraulic fluid (fixed orifice) when the speed limiting switch is turned on. As a result, the winch drive speed is reduced, and even when the hook over-winding prevention apparatus subsequently operates as the stop switch is turned on, the suspended object does not swing upward to a great degree and the upward hoist motion of the hook is immediately stopped.

DISCLOSURE OF THE INVENTION

However, in the apparatus disclosed in the publication, the position at which the speed reduction starts is determined in correspondence to the position at which the speed limiting switch is mounted and the ratio of the speed reduction (deceleration) is determined by the degree of the fixed orifice, bearing no relation to the hoist speed. Thus, if the speed reduction start position and the speed reduction ratio are set in correspondence to a high hoist speed, the speed reduction starts too early when the hoist operation is performed at low speed, to result in poor work efficiency. If, on the other hand, the speed reduction start position and the speed reduction ratio are set in correspondence to a low hoist speed, the speed reduction starts too late when the hoisting operation is performed at high speed, to induce the problem discussed earlier of the upward swing of the suspended object.

An object of the present invention is to provide a winch over-winding prevention apparatus that is capable of stopping a hoist operation of a suspended load with optimal timing without inducing poor work efficiency or upward swing of the suspended object.

In order to attain the above object, a winch over-winding prevention apparatus according to the present invention comprises: a winch drum that is driven for up/down hoist in response to a command issued through an operating lever; a stop switch that is activated when a suspended object raised or lowered as a hoisting cable wound around the winch drum is further taken up or fed out is hoisted up to a predetermined stop position; and a stop device that stops drive of the winch drum when the stop switch is activated, and further comprises: a speed detection device that detects a hoist speed of the suspended object; a speed reduction device that reduces a drive speed of the winch drum once the suspended object reaches a predetermined speed reduction start position; and a speed reduction control device that calculates a deceleration rate of the winch drum in correspondence to the hoist speed of the suspended object detected by the speed detection device and controls drive of the speed reduction device in response to a speed reduction command corresponding to the deceleration rate.

In this winch over-winding prevention apparatus, it is preferred that the speed reduction control device calculates the deceleration rate so as to set the drive speed of the winch drum immediately prior to a stop at the predetermined stop position to a predetermined speed regardless of the hoist speed detected by the speed detection device. Furthermore, it is preferred that the speed reduction control device calculates the deceleration rate so as to set the drive speed of the winch drum to the predetermined speed at a speed reduction end position set between the speed reduction start position and the predetermined stop position, and controls the drive of the speed reduction device by outputting a speed reduction command corresponding to the deceleration rate until the suspended object having departed the speed reduction start position reaches the speed reduction end position and outputting a constant speed command corresponding to the predetermined speed until the suspended object having departed the speed reduction end position reaches the stop position.

Another winch over-winding prevention apparatus comprises: a winch drum that is driven for up/down hoist in response to a command issued through an operating lever; a stop switch that is activated when a suspended object raised or lowered as a hoisting cable wound around the winch drum is further taken up or fed out is hoisted up to a predetermined stop position; and a stop device that stops drive of the winch drum when the stop switch is activated, and further comprises: a speed detection device that detects a hoist speed of the suspended object; a position detection device that outputs a signal corresponding to a raised or lowered position of the suspended object; a speed reduction device that reduces a drive speed of the winch drum; and a speed reduction control device that calculates a speed reduction start position in correspondence to the hoist speed of the suspended object detected by the speed detection device and controls drive of the speed reduction device by outputting a predetermined speed reduction command when the suspended object is detected to have reached the speed reduction start position through a signal output by the position detection device.

In this winch over-winding prevention apparatus, it is preferred that the speed reduction control device outputs a speed reduction command to reduce the drive speed of the winch drum at a constant deceleration rate and calculates the speed reduction start position so as to set the drive speed of the winch drum immediately prior to a stop at the predetermined stop position to a predetermined speed. Furthermore, it is preferred that the speed reduction control device calculates the speed reduction start position so as to set the drive speed of the winch drum to the predetermined speed at a speed reduction end position set between the speed reduction start position and the predetermined stop position, and controls the drive of the speed reduction device by outputting a speed reduction command corresponding to the predetermined deceleration rate until the suspended object having departed the speed reduction start position reaches the speed reduction end position and outputting a constant speed command corresponding to the predetermined speed until the suspended object having departed the speed reduction end position reaches the stop position.

Also, in this winch over-winding prevention apparatus, it is preferred that the speed reduction control device also calculates a deceleration rate of the winch drum in correspondence to the hoist speed of the suspended object detected by the speed detection device and controls the drive of the speed reduction device by outputting a speed reduction command corresponding to the deceleration rate when the suspended object is detected to have reached the speed reduction start position through a signal output by the position detection device.

Another winch over-winding prevention apparatus comprises: a winch drum that is driven for up/down hoist in response to a command issued through an operating lever; a stop switch that is activated when a suspended object raised or lowered as a hoisting cable wound around the winch drum is further taken up or fed out is hoisted up to predetermined stop position; and a stop device that stops drive of the winch drum when the stop switch is activated, and further comprises: a speed reduction device that reduces a drive speed of the winch drum once the suspended object reaches a predetermined speed reduction start position; and a speed reduction control device that controls drive of the speed reduction device by outputting a speed reduction command until the suspended object having departed the speed reduction start position reaches a predetermined speed reduction end position and outputting a constant speed command until the suspended object having departed the speed reduction end position reaches the stop position.

In each of the above winch over-winding prevention apparatuses, it is preferred that the speed reduction device controls a physical quantity bearing a correlation to a motor rotation rate of a hydraulic motor that drives a winch drum; and the speed reduction control device resets an output of the speed reduction command when the operating lever is driven for a hoist-down.

In each of the above winch over-winding prevention apparatuses, it is preferred that the stop device is provided with a negative brake device that stops drive of the winch drum.

Another winch over-winding prevention apparatus comprises: a winch drum that is driven for up/down hoist in response to a command issued through an operating lever; a stop switch that is activated when a suspended object raised or lowered as a hoisting cable wound around the winch drum is further taken up or fed out is hoisted up to a predetermined stop position; and a stop device that stops drive of the winch drum when the stop switch is activated, and further comprises: a position detection device that outputs a signal corresponding to a raised or lowered position of the suspended object; a speed reduction device that reduces a drive speed of the winch drum; and a speed reduction control device that controls drive of the speed reduction device by outputting a predetermined speed reduction command when the position detection device detects a speed reduction start position set in correspondence to a predetermined maximum hoist speed for the suspended object.

In this winch over-winding prevention apparatus, it is preferred that the speed reduction control device outputs a speed reduction command to reduce the drive speed of the winch drum at a constant deceleration rate and sets the speed reduction start position so as to set the drive speed of the winch drum immediately prior to a stop at the predetermined stop position to a predetermined speed.

As explained above, since the speed of the winch drum is reduced at a deceleration rate corresponding to the speed with which the suspended object is being hoisted and the speed reduction start position is changed in correspondence to the speed at which the suspended object is being hoisted, the hoist speed immediately before a stop can be set at a specific low speed regardless of the hoist speed immediately before the speed reduction. As a result, the suspended load can be stopped with the optimal timing corresponding to the hoist speed. In addition, the work efficiency is not compromised and no upward swing of the suspended object is induced. Furthermore, since the execution of the speed reduction command is completed before the suspended object reaches the stop position and the winch is driven at a constant speed, the winch is driven at a specific speed set to ensure that the winch at the stop position remains unaffected by any adverse factors such as an assembly error and then is stopped. Moreover, the winch drum is slowed down by outputting a specific speed reduction command when the position detection device detects the speed reduction start position set in correspondence to the specific maximum suspended object hoist speed, it is not necessary to detect the hoist speed of the suspended object, thereby achieving structural simplicity.

BEST MODE FOR CARRYING OUT THE INVENTION

The following is an explanation of the embodiments of the present invention, given in reference to the drawings.

First Embodiment

Figure 1:
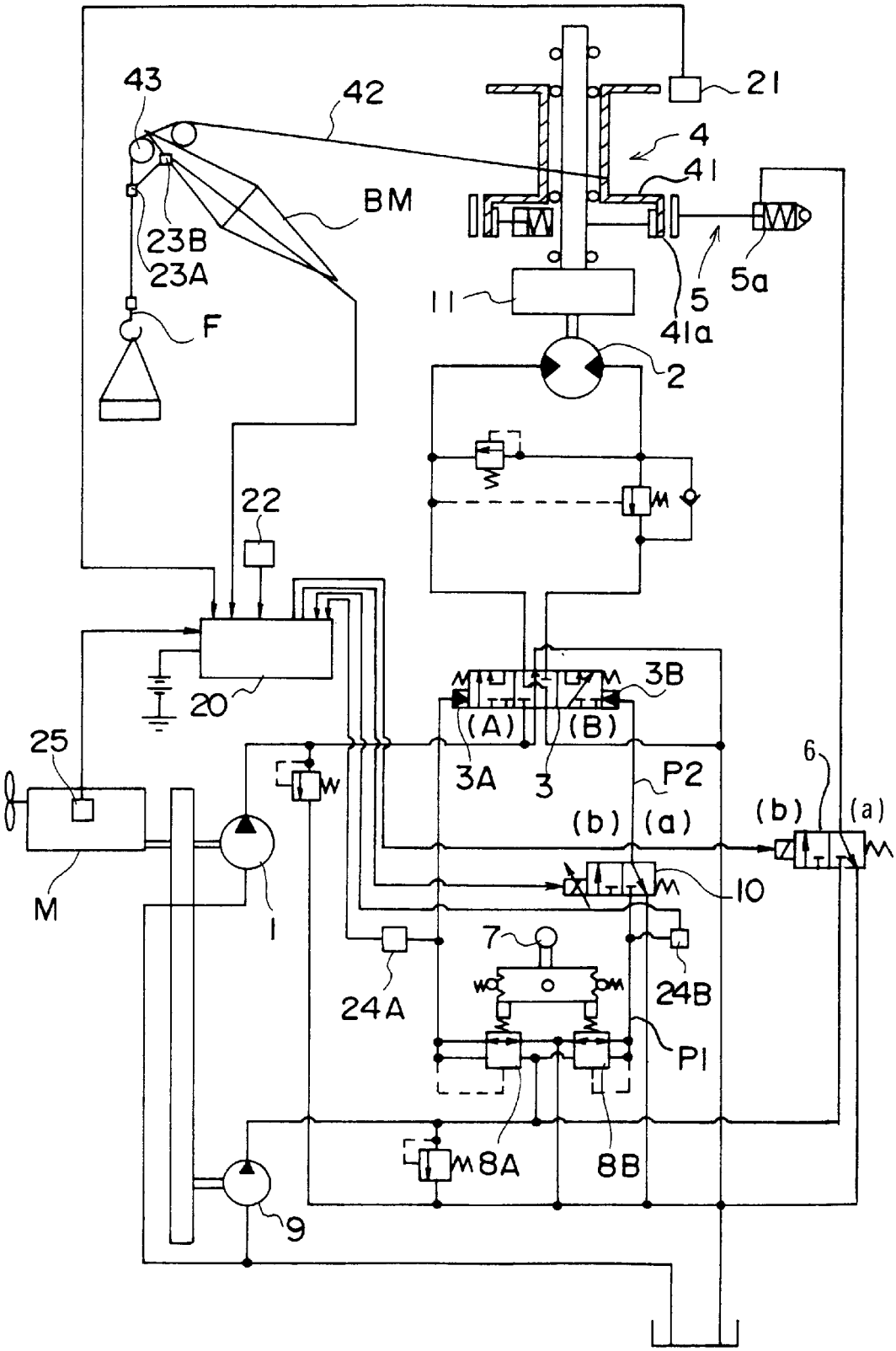
FIG. 1 is a hydraulic circuit diagram illustrating the structure of the winch over-winding prevention apparatus in a first embodiment of the present invention.

FIG. 1 is a hydraulic circuit diagram illustrating the structure of the winch over-winding prevention apparatus in the first embodiment of the present invention. As shown in FIG. 1, the over-winding prevention apparatus in the first embodiment comprises a main pump 1 with a fixed capacity which is driven by a driving motor M, a hydraulic motor 2 with a fixed capacity which is driven by the pressure oil discharged from the main pump 1, a directional control valve 3 that controls the flow of the pressure oil supplied from the main pump 1 to the hydraulic motor 2, a winch 4 which is driven for upward and downward hoisting by the drive torque imparted by the hydraulic motor 2, a break device 5 that applies brakes on a drum 41 of the winch 4, an electromagnetic switching valve (hereafter simply referred to as the electromagnetic valve) 6 that controls the drive of the break device 5, an operating lever 7, through which the operator enters hoist up/down commands for the winch 4, pilot valves 8A and 8B operated through the operating lever 7, a pilot pump 9 from which the pressure oil is supplied to the pilot valves 8A and 8B, an electromagnetic proportional pressure reduction valve 10 (hereafter simply referred to as the electromagnetic proportional valve) that controls the pilot pressure P2 supplied to a pilot port 3B of the directional control valve 3 from the pilot valve 8B and a controller 20 that outputs a control signal to the electromagnetic valve 6 and the electromagnetic proportional valve 10.

The brake device 5 is provided with a brake cylinder 5*a* for driving brake pad that presses against a brake drum 41*a* provided as an integrated part of the drum 41, and the supply of the pressure oil to the brake cylinder 5*a* is controlled by switching the electromagnetic valve 6. The electromagnetic valve 6 is switched to a position (a) in response to an OFF signal output by the controller 20 and is switched to a position (b) in response to and ON signal from the controller 20. When the electromagnetic valve 6 is switched to the position (a), a rod-side oil chamber of the brake cylinder 5*a* is allowed to communicate with the tank and the cylinder 5*a* is caused to extend by the force applied by a spring provided at the brake cylinder 5*a*. As a result, a braking force is applied to the brake drum 41*a* via the brake pad to set the operation in a braked state. When the electromagnetic valve 6 is switched to the position (b), the pressure oil is supplied from the pilot pump 9 to the rod-side oil chamber of the brake cylinder 5*a* to cause the cylinder 5*a* to contract and recede and, as a result, the brake pad departs from the brake drum 41*a* to set the operation in a brake-released state.

A hoisting cable 42 is wound around the drum 41 of the winch 4, and the hoisting cable 42 is connected to a hook F via a point sheave 43 provided at the front end of a boom BM. The drive torque imparted by the hydraulic motor 2 is communicated to the winch 4 via a speed reducer 11 and as the winch 4 is driven for an up/down hoist operation, the hoisting cable 42 is wound onto or delivered from the drum 41 to cause the hook F to move up or down. Near the drum 41, a rotation detector 21 such as a rotary encoder is provided to detect the rotation quantity θ of the drum 41, and a lift range gauge 22 that detects the position of the hook F is provided in the operator's cab (not shown). The lift range gauge 22, which is reset to 0 at a preset reference point, detects the hook position relative to the reference point by counting the signals provided by the rotation detector 21. Near the point sheave 43, a weight 23A suspended from the boom BM and a hook over-wind switch 23B are provided. If the hook F becomes over wound due to an over-wind of the hoisting cable 42, the weight 23A is lifted to turn off the hook over-wind switch 23B. When the hook over-wind switch 23B is turned off, the hook over-winding prevention apparatus is activated to stop the drive of the winch 4 as detailed later. Pressure switches 24A and 24B are provided respectively between the pilot valve 8A and the pilot port 3A of the directional control valve 3 and between the pilot valve 8B and the electromagnetic proportional valve 10, and the sensitivity levels of the pressure switches 24A an and 24B are set so that they are turned on in response to even slight pilot pressures from the pilot valves 8A and 8B. In other words, the pressure switches 24A and 24B detect whether or not the operating lever 7 has been operated. A rotation rate sensor 25, which detects a motor rotation rate n is provided at the driving motor M. It is to be noted that while a clutch device which is connected and disconnected by interlocking with the operation of the operating lever 7 and a brake device which is engaged and released through a pedal operation are provided at the winch 4, their illustrations are omitted.

Figure 2:
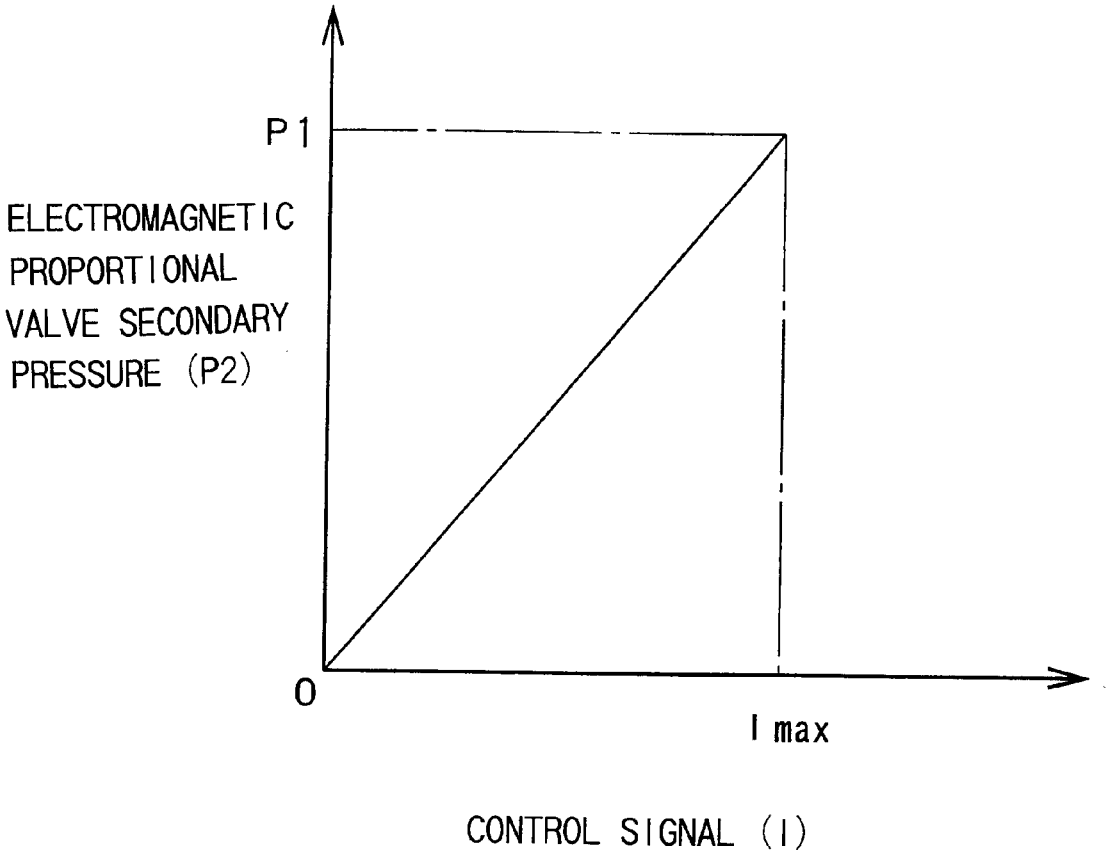
FIG. 2 shows the control characteristics (the secondary pressure corresponding to the control signal) of the electromagnetic proportional valve in the embodiment of the present invention.

The rotation detector 21, the lift range gauge 22, the hook over-wind switch 23B, the pressure switches 24A and 24B and the rotation rate sensor 25 are all connected to the controller 20. The controller 20 takes in signals provided by the detectors 21, 22 and 25 and the switches 23B, 24A and 24B to execute processing which is to be detailed later, outputs ON/OFF signals to the electromagnetic valve 6 and outputs a control signal I to the electromagnetic proportional valve 10. The relationship between the control signal I and the secondary pressure P2 at the electromagnetic proportional valve 10 is shown in FIG. 2. As shown in FIG. 2, the secondary pressure P2 at the electromagnetic proportional valve 10 achieves the maximum value (=P1) when the control signal I is I=I max, and in this state, the primary pressure P1 from the pilot valve 8B corresponding to the degree to which the operating lever 7 has been operated is directly supplied to the pilot port 3B of the directional control valve 3 without becoming reduced. In addition, when the control signal I is I=0, the secondary pressure P2 at the electromagnetic proportional valve 10 is P2=0, and in this state, no pilot pressure oil is supplied to the pilot port 3B of the switching valve 3 even if the operating lever 7 is engaged in a hoist operation.

Figure 3A:
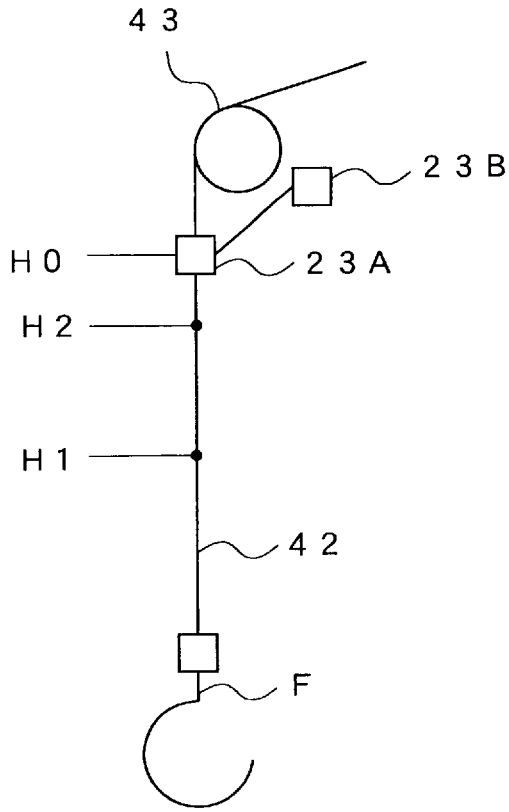
FIGS. 3A and 3B illustrate the definitions of the various constants used in the winch over-winding prevention apparatus in the embodiment of the present invention.
Figure 3B:
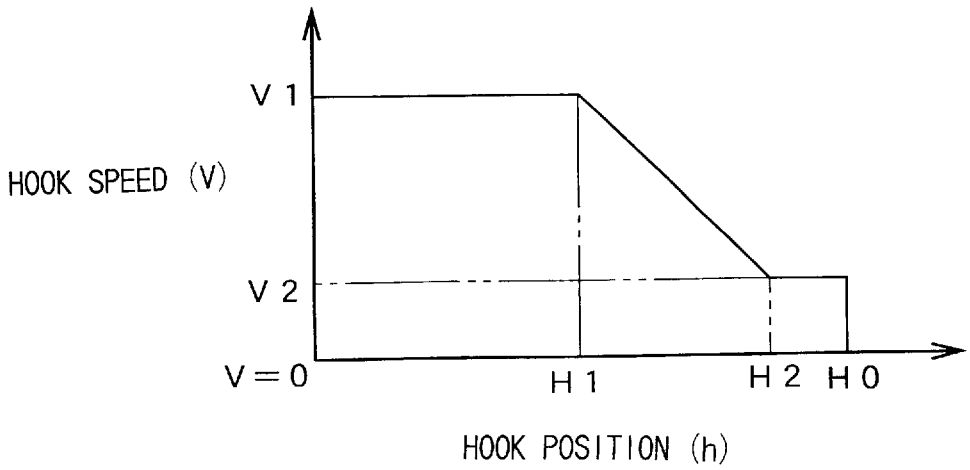

As shown in FIG. 3A, the position of the weight 23A (hereafter referred to as the hook over-wind activation position) is set as a reference position H0, the position set over a distance H1 from the reference position H0 is assigned as a speed reduction start position H1 and the position set over a distance H2 from the reference position H0 is assigned as a speed reduction end position H2 in this embodiment. In addition, as shown in FIG. 3B, speed reduction control is implemented on the hoist speed v of the hook F to be reduced from v1 to v2 in the block between the speed reduction start position H1 and the speed reduction end position H2, constant speed control (=v2) is implemented on the hook hoist speed v in the block between the speed reduction end position H2 and the hook over-wind activation position H0 and the upward hoist motion of the hook F is stopped once the hook F reaches the hook over-wind activation position H0. This control is achieved through the processing executed by the controller 20 as described below.

Figure 4:
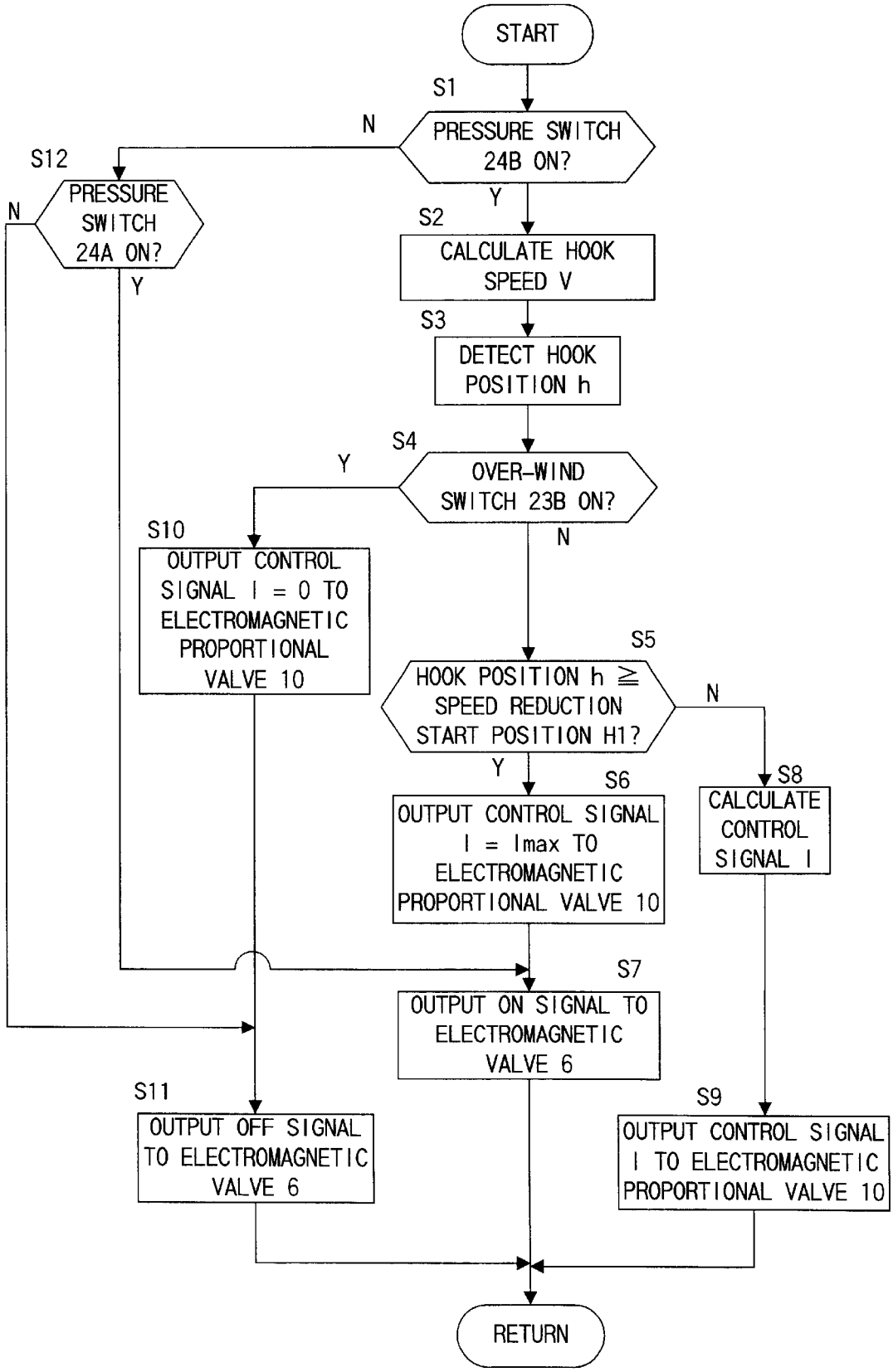
FIG. 4 is a flowchart of the processing implemented by the controller constituting the winch over-winding prevention apparatus in the first embodiment of the present invention.

FIG. 4 is a flowchart of the processing executed by the controller 20. The processing in this flowchart is started by turning on the engine key switch (not shown), for instance, and executed repeatedly. First, in step S1, a decision is made as to whether or not the pressure switch 24B is in an ON state, i.e., whether or not the operating lever 7 is currently engaged in a hoist operation. If an affirmative decision is made in step S1, the operation proceeds to step S2, in which the detection value θ from the rotation detector 21 is read and the hook speed v is calculated. By disregarding the number of turns of the cable 42 wound around the drum 41 and the number of turns of the cable 42 wound around the hook F, the hook speed v is calculated through the following formula (I)

$$v=r\cdot\theta v \ldots \quad \text{(I)},$$

with θv: drum angular speed (time differential of drum rotation quantity θ (radians) and r: drum radius.

Next, the hook position h is detected by using the lift range gauge 22 in step S3. When using the lift range gauge 22, a reset must be performed in advance to set a reference point, and in this embodiment, the hook over-wind activation position H0 is set as the reference point. This enables the lift range gauge 22 to calculate the distance h from the hook over-wind activation position H0. In the following step S4, a decision is made as to whether or not the hook over-wind switch 23B is in an ON state. If a negative decision is made in step S4, the operation proceeds to step S5 to make a decision as to whether or not the hook position h indicates a value equal to or larger than the value corresponding to the speed reduction start position H1 in FIG. 3, i.e., whether or not the hook F is lower than the speed reduction start position H1. The value indicated by the speed reduction start position H1 represents the distance from the hook over-wind activation position H0 to the speed reduction start position H1. If an affirmative decision is made in step S5, the operation proceeds to step S6, in which a control signal I=I max is output to the electromagnetic proportional valve 10, and in the following step S7, an ON signal is output to the electromagnetic valve 6 before the operation makes a return.

If a negative decision is made in step S5, the operation proceeds to step S8 to calculate the control signal I to be output to the electromagnetic proportional valve 10 as detailed later, and in the following step S9, the signal I is output before the operation makes a return. If, on the other hand, an affirmative decision is made in step S4, the operation proceeds to step S10 in which a control signal I=0 is output to the electromagnetic proportional valve 10 and in the following step S11, an OFF signal is output to the electromagnetic valve 6 before the operation makes a return. If a negative decision is made in step S1, the operation proceeds to step S12 to make a decision as to whether or not the pressure switch 24A is in an ON state, i.e., whether or not the operating lever 7 is engaged in a hoist-down operation. If an affirmative decision is made in step S12, the operation proceeds to step S7, whereas if a negative decision is made in step S12, the operation proceeds to step S11.

Figure 5:
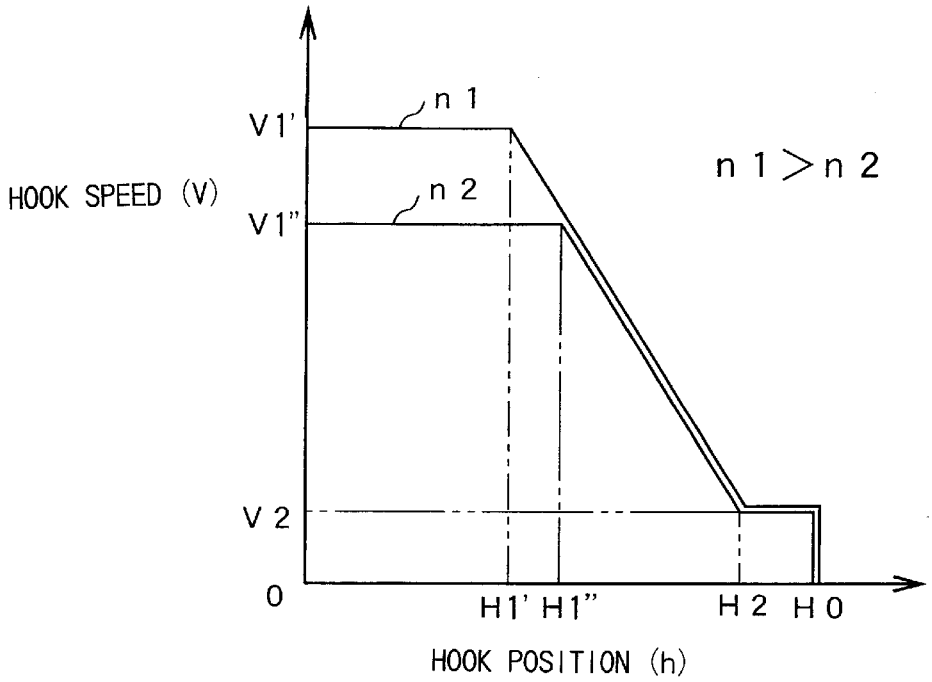
FIG. 5 shows the operating characteristics (the relationship between the hook position and the hook speed) of the winch over-winding prevention apparatus in the embodiment of the present invention.
Figure 6:
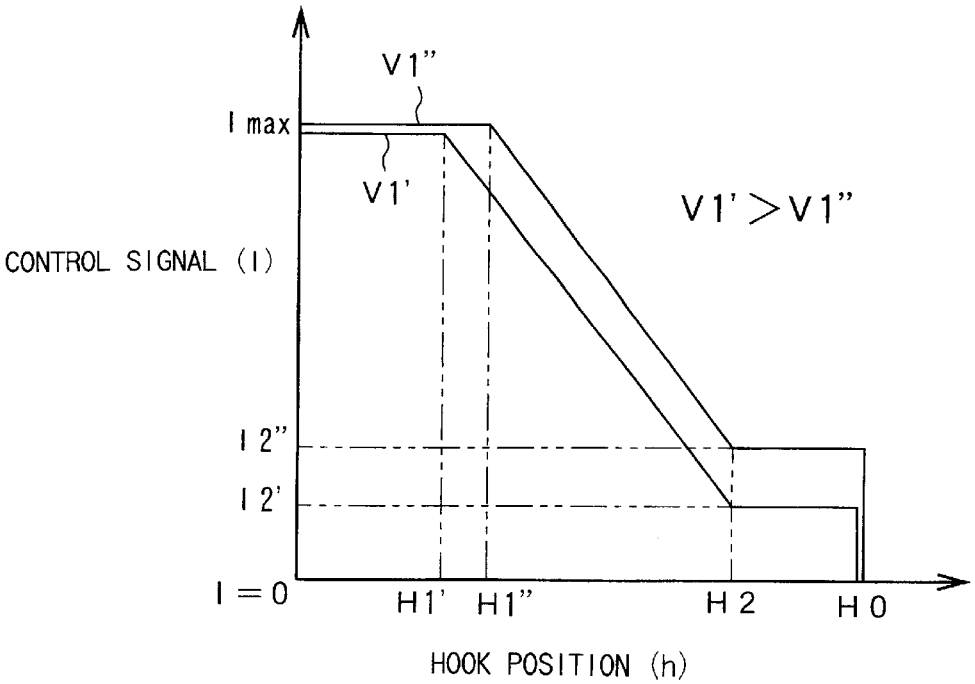
FIG. 6 shows the control signal output in correspondence to the hook position in the winch over-winding prevention apparatus in the embodiment of the present invention.

The following explanation on the control signal I calculated in step S8 is given on the premise that the operating lever 7 is engaged in a full hoist-up operation. The hook speed v is an increasing function of the motor rotation rate and the motor rotation rate is an increasing function of the quantity of the pressure oil supplied to the hydraulic motor 2. The quantity of the pressure oil supplied to the hydraulic motor 2 is determined by the discharge quantity from the hydraulic pump 1 and the pilot pressure P2 which causes the control valve 3 to stroke. The discharge quantity from the hydraulic pump 1 and the pilot pressure P2 at the control valve 3, in turn, are respectively determined by the driving motor rotation rate n and the rate of pressure reduction at the electromagnetic proportional valve 10. Ultimately, the hook speed v is determined by the driving motor rotation rate n and the rate of pressure reduction at the electromagnetic proportional valve 10, and thus, a signal n from the rotation rate sensor 25 is read and the control signal I corresponding to the hook position h is calculated so as to reduce the hook speed v in conformance to the pre-assigned characteristics shown in FIG. 5 in step S8, and the control signal I is output to control the rate of pressure reduction in step S9. It is to be noted that the control signal I corresponding to the hook speed v in FIG. 5 may be provided as shown in FIG. 6, for instance. As shown in FIGS. 5 and 6, the values of the speed reduction start position H1' or H1" used in step S5 corresponds to the hook speed v1' or v1" at the driving motor rotation rate n1 or n2 at the speed reduction start, and the speed v2 at the speed reduction end position H2 is constant regardless of whether the value of the hook speed is v1' or v1". In addition, the inclinations (deceleration dv/dh) of the individual characteristics in the blocks between the speed reduction start position H1' and the speed reduction end position H2 and between the speed reduction start position H1" and the speed reduction end position H2 are the same regardless of whether the hook speed at the speed reduction start is v1' or v1". The speed v2 beyond the speed reduction end position H2 is also constant. It is to be noted that the hook speed v2 at the speed reduction end position H2 is set low to minimize the shock occurring when the hook stops, and the distance from the speed reduction end position H2 to the stop position H0 is set at a value at which errors occurring at the individual detectors 21~24, assembly errors and the like are absorbed.

Next, the operation achieved in the embodiment is explained in more specific terms.

(1) hook position h>speed reduction start position H1

When the operating lever 7 is fully engaged in a hoist-up operation to hoist up the hook F, the pilot valve 8B is driven to the maximum. At this time, if the hook F is positioned lower than the speed reduction start position H1, the electromagnetic proportional valve 10 is switched to the position (b) through the processing implemented in step S6 described earlier. In this state, the electromagnetic proportional valve 10 simply functions as a release valve, and the electromagnetic valve 6 is switched to the position (b) through the processing in step S7. When the electromagnetic proportional valve 10 is switched to the position (b), the pressure oil P1 from the pilot valve 8B is supplied to the pilot port 3B of the control valve 3 via the electromagnetic proportional valve 10, thereby switching the control valve 3 to position (B). The pressure oil is output from the main pump 1 in the quantity corresponding to the driving motor rotation rate n, and as the control valve 3 is switched to the position (B), this pressure oil is supplied to the hydraulic motor 2 via the control valve 3 to drive the hydraulic motor 2 along the hoist up direction at the speed corresponding to the driving motor rotation rate n. In addition, when the electromagnet valve 6 is switched to the position (b), the pressure oil from a hydraulic source 9 is supplied to the rod-side oil chamber of the brake cylinder 5*a* via the electromagnetic valve 6, thereby releasing the brake device 5. As a result, the winch drum 41 is driven in the hoist-up direction to take up the hoisting cable 42, causing the hook F to travel upward.

(2) speed reduction start position H1≧hook position h

After the hook F reaches the speed reduction start position H1, the value indicated by the control signal I output to the electromagnetic proportional pressure reduction valve 10 is gradually reduced in conformance to the characteristics presented in FIG. 6 (step S8 and step S9 in FIG. 4), and the electromagnetic proportional valve 10 is switched to the position (a), resulting in a gradual reduction in the secondary pressure P2 supplied to the pilot port 3B. Thus, even though the operating lever 7 is fully engaged in a hoist-up operation, the control valve 3 is driven from the position (B) to the neutral position to reduce the speed of the winch 4. Once the hook F reaches the speed reduction end position H2, the control signal I output to the electromagnetic proportional valve 10 sustains a value (I2' or I2" in FIG. 6) corresponding to the driving motor rotation rate n and the quantity of the pressure oil supplied to the hydraulic motor 2 becomes constant to drive the winch at a constant speed (v2 in FIG. 5). When the hook F reaches the hook over-wind activation position H0, the over-wind switch 23B is turned on and the electromagnetic proportional valve 10 is switched to the position (a) (step S10 in FIG. 4) to stop the supply of the pressure oil to the pilot port 3B of the control valve 3. In addition, the electromagnetic valve 6 is switched to the position (a) (step S11 in FIG. 4) to stop the supply of the pressure oil to the brake cylinder 5*a*. As a result, the control valve 3 is switched to the neutral position, thereby stopping the drive of the hydraulic motor 2, and also, a negative brake 5 operates to stop the drive of the winch drum 41.

If the operating lever 7 is engaged in a hoist-down operation in a state in which the hook F is at a position higher than the speed reduction start position H1 and the hook speed v is being reduced or the hook over-winding prevention apparatus is engaged in operation, the pilot valve 8A is driven and the pressure oil from the pilot valve 8A is supplied to the pilot port 3A of the control valve 3 to switch the control valve to position (A). When the control valve is switched to the position (A), the pressure oil from the main pump 1 is supplied to the hydraulic motor 2 via the control valve 3 and the hydraulic motor 2 is driven in the hoist-down direction as a result. In addition, since the pressure switch 24B is turned off and the pressure switch 24A is turned on when the operating lever 7 is engaged in a hoist-down operation, a negative decision is made in step S1 and an affirmative decision is made in step S12 in FIG. 4 to allow the operation to proceed to step S7. In step S7, the electromagnetic valve 6 is switched to the position (b) to disengage the brake device 5. This causes the winch drum 41 to be driven in the hoist-down direction during a hoist-down operation to lower the suspended load.

As explained above, in the first embodiment in which the pilot pressure P2 is reduced to decelerate the upward hoist motion of the hook F in the block between the speed reduction start position Hl and the speed reduction end position H2 and the drive of the winch 4 is stopped at the hook over-wind activation position H0, the upward hoist motion of the hook F can be stopped with optimal timing without inducing an upward swing of the suspended object and the like. In this case, since it is not necessary to offset the hook over-wind activation position H0 to a lower position even when the hook speed v1 is high, a sufficient operating range can be assured. In addition, the speed reduction start position H1 is changed in correspondence to the hook speed v1 so that the winch 4 can be slowed down in a stable state in which breaks are not applied suddenly. Furthermore, since the hook over-winding prevention apparatus is engaged in operation after sustaining a low speed state between the position H2 and the position H0, the winch 4 can be stopped in a stable state without being affected by errors of the detectors 21~24, assembly errors or the like. Moreover, the hook speed v is not reduced during a hoist-down operation to ensure that good operating efficiency is achieved.

Second Embodiment

Figure 7:
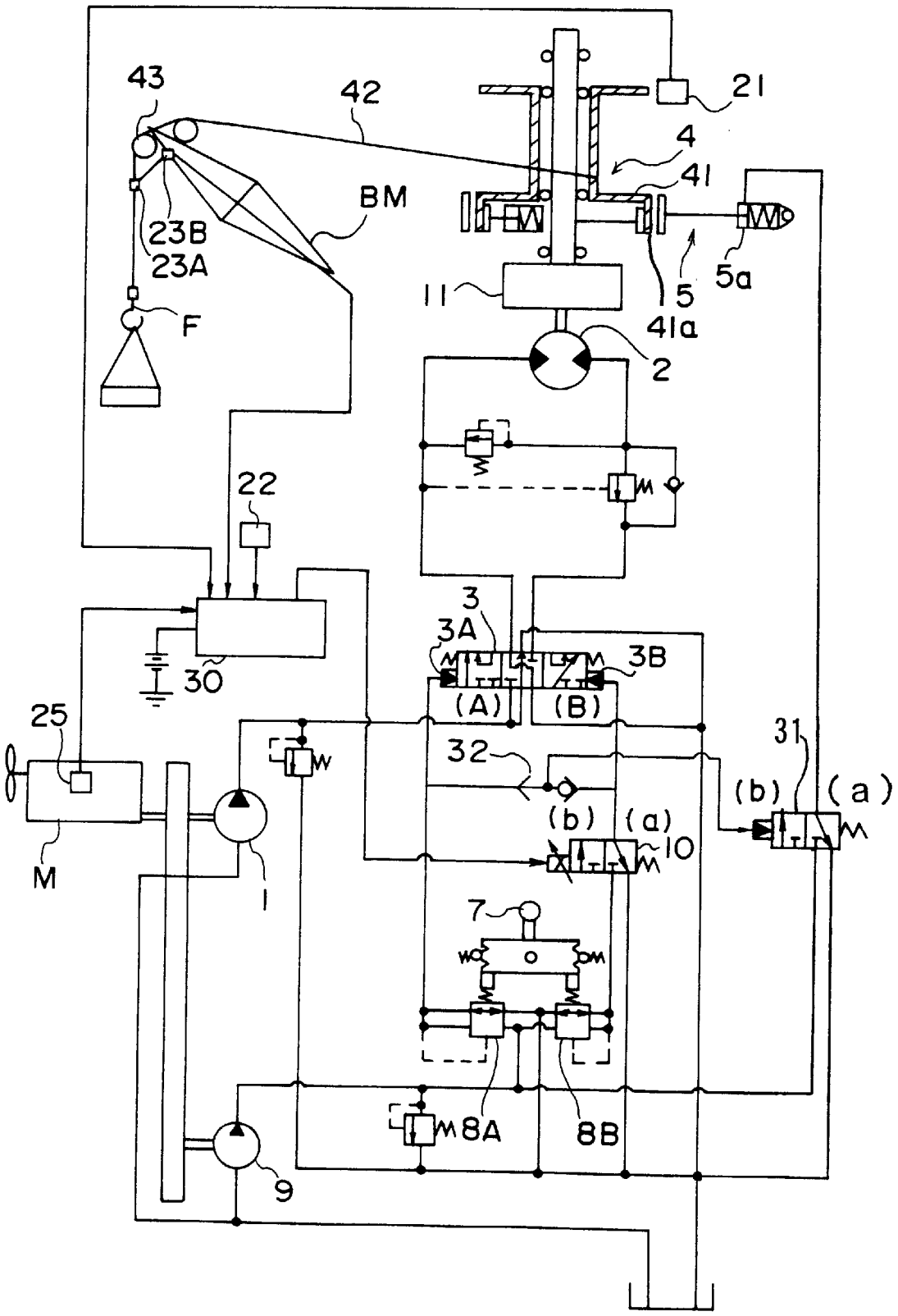
FIG. 7 is a hydraulic circuit diagram illustrating the structure of the winch over-winding prevention apparatus in a second embodiment of the present invention.
Figure 8:
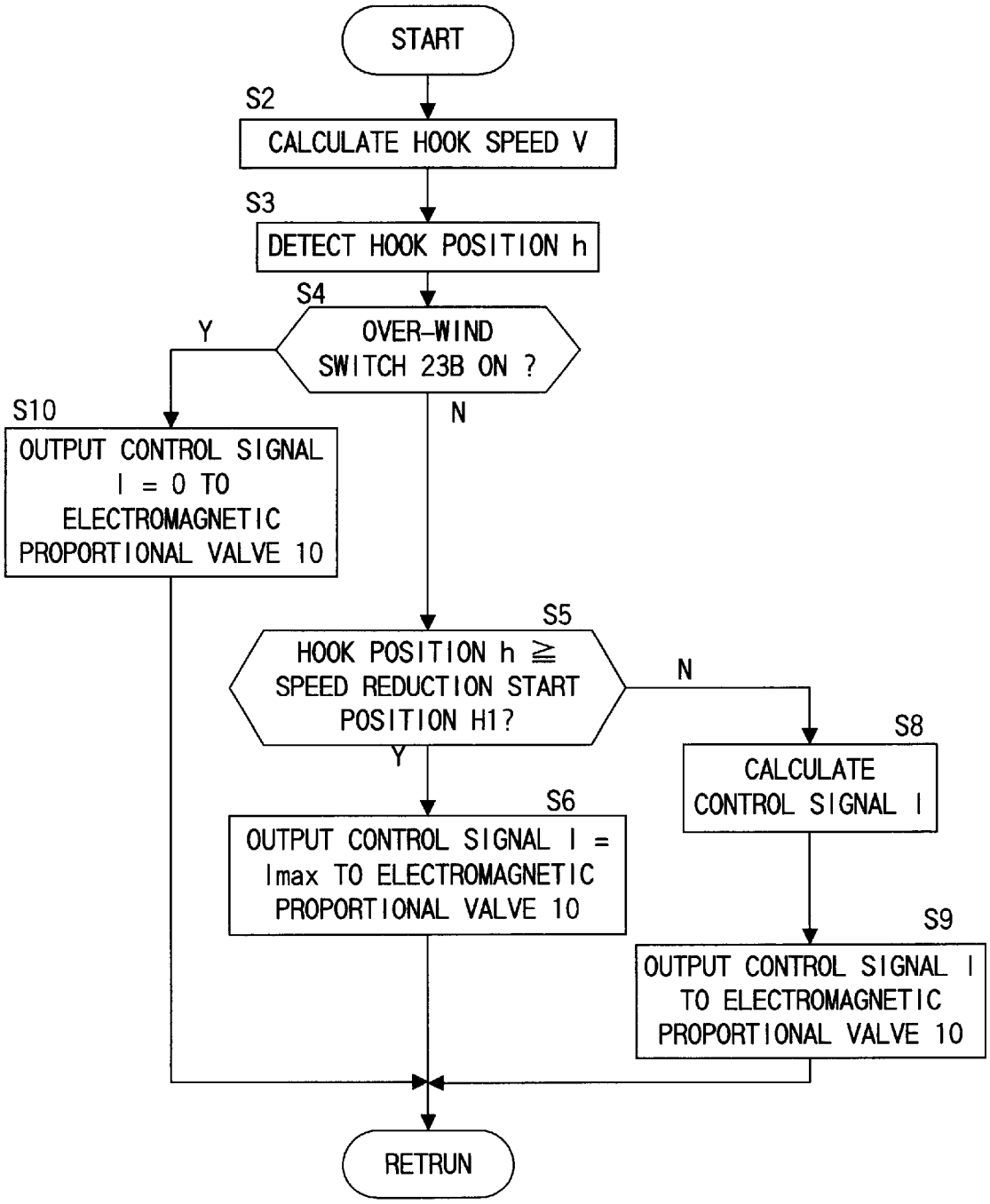
FIG. 8 is a flowchart of the processing implemented by the controller constituting the winch over-winding prevention apparatus in the seconds embodiment of the present invention.

FIG. 7 is a hydraulic circuit diagram illustrating the structure of the winch over-winding prevention apparatus in the second embodiment of the present invention and FIG. 8 is a flowchart of the processing implemented by a controller 30 in the hydraulic circuit diagram shown in FIG. 7. It is to be noted that the following explanation given in reference to FIG. 7 and 8 mainly focuses on the differences from the first embodiment by assigning the same reference numbers to components identical to those in FIGS. 1 and 4.

In FIG. 7, a hydraulic pilot switching valve 31 is provided in place of the electromagnetic valve 6 and the pressure switches 24A and 24B are omitted. The hydraulic pilot switching valve 31 is switched from a position (a) to a position (b) in response to a slight pilot pressure imparted from the pilot valve 8A or 8B supplied via a shuttle valve 32. As a result, when the operating lever 7 is engaged in a hoist-down operation or the operating lever 7 is engaged in a hoist-up operation while the electromagnetic proportional valve 10 is set to the position (b), the hydraulic pilot switching valve 31 is switched to the position (b) and the pressure oil from the pilot pump 9 is supplied to the brake cylinder 5*a* to release the brake device 5.

Since the pressure switches 24A and 24B and the electromagnetic valve 6 are not provided in the second embodiment, the controller 30 does not need to implement the processing in step S1, step S7, step S11 and step S12 as shown in FIG. 8, achieving simplification in the control compared to FIG. 4. Through the processing shown in FIG. 8, an operation similar to that in the first embodiment is achieved in the second embodiment. Namely, when the operating lever 7 is fully engaged in a hoist-up operation, a control signal I corresponding to the driving motor rotation rate n and the hook position h is output to the electromagnetic proportional valve 10 as shown in FIG. 5 and the hook speed v is controlled as shown in FIG. 6.

Third Embodiment

Figure 9:
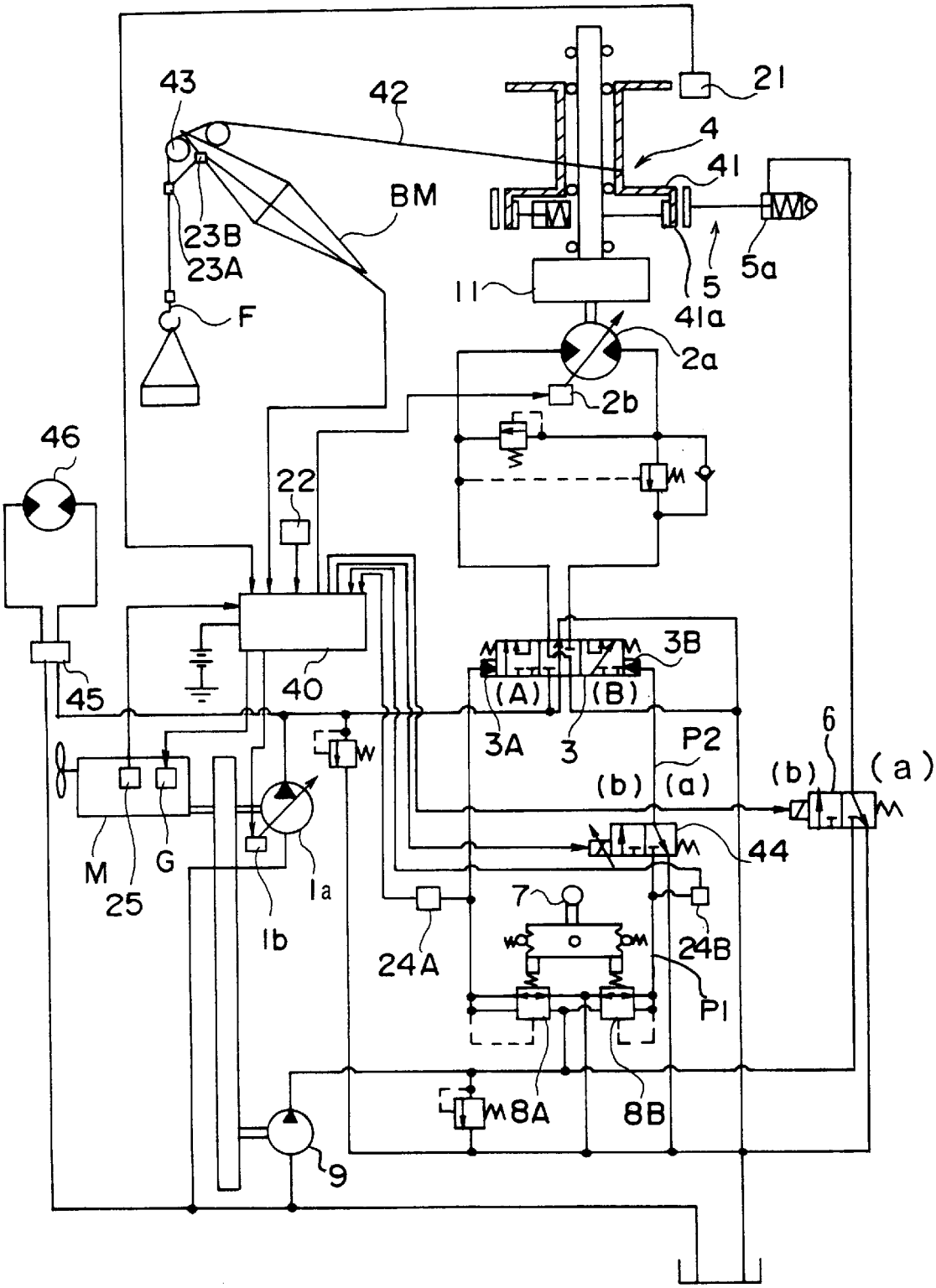
FIG. 9 is a hydraulic circuit diagram illustrating the structure of the winch over-winding prevention apparatus in a third embodiment of the present invention.
Figure 10:
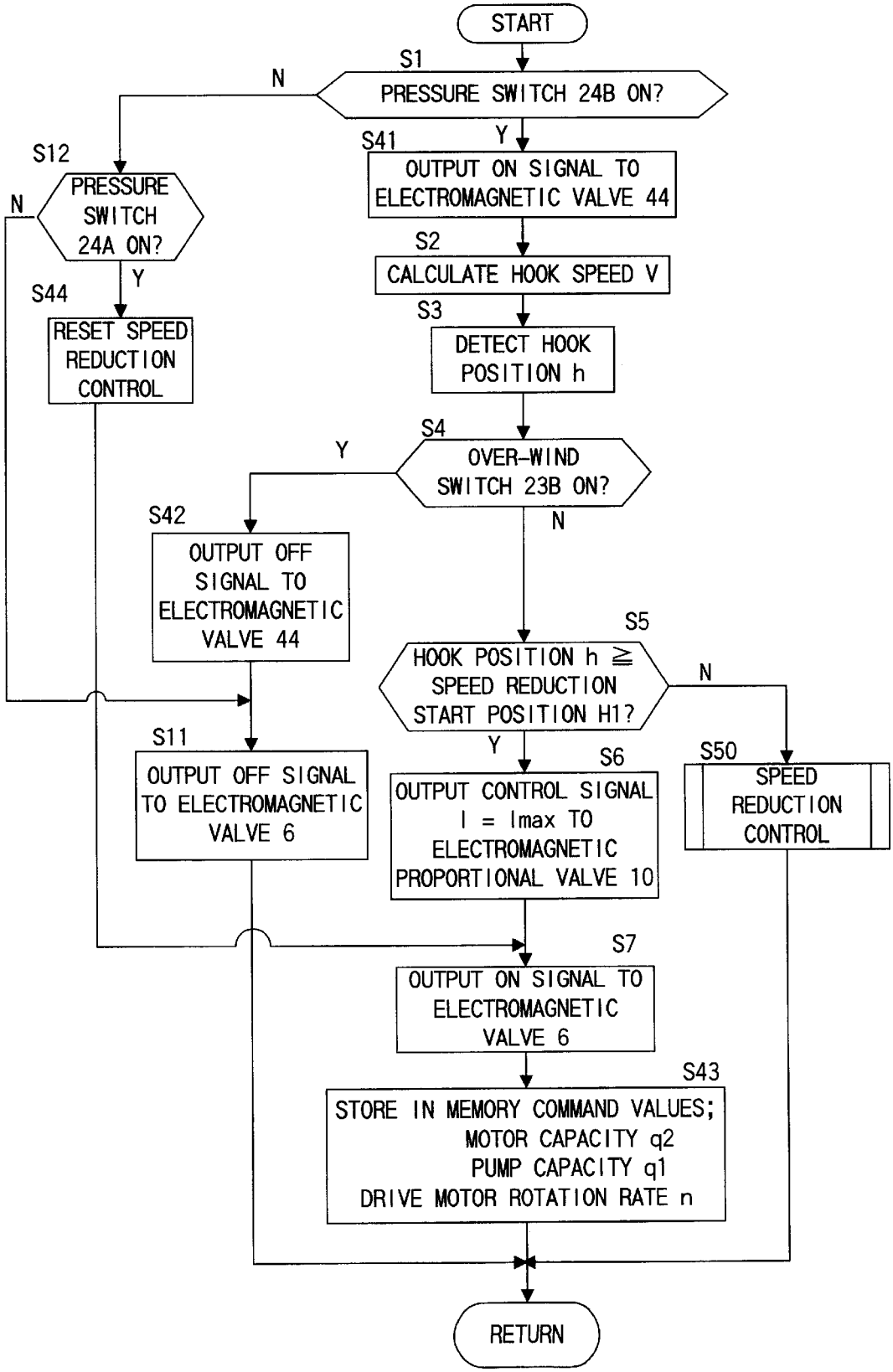
FIG. 10 is a flowchart of the processing implemented by the controller constituting the winch over-winding prevention apparatus in the third embodiment of the present invention.

FIG. 9 is a hydraulic circuit diagram illustrating the structure of the winch over-winding prevention apparatus in the third embodiment of the present invention and FIG. 10 is a flowchart of the processing implemented by a controller 40 in the hydraulic circuit diagram shown in FIG. 9. It is to be noted that the following explanation given in reference to FIGS. 9 and 10 mainly focuses on the differences from the embodiment shown in FIGS. 1 and 4 by assigning the same reference numbers to components identical to those in FIGS. 1 and 4. In FIG. 9, an ON/OFF type electromagnetic valve 44 is provided in place of the electromagnetic proportional valve 10, and the electromagnetic valve 44 is switched to a position (b) in response to an ON signal (I=Imax) from the controller 40 and is switched to the position (a) in response to an OFF signal (I=0) from the controller 40. In addition, a main pump 1*a* and a hydraulic motor 2*a* both adopt a variable capacity system, with a regulator 1*b* that adjusts the pump tilt angle (pump capacity) and a regulator 2*b* that adjusts the motor tilt angle (motor capacity) both connected to the controller 40 together with a governor G which adjusts the driving motor rotation rate n. The controller 40 executes processing which is to be detailed below by taking in signals from the rotation detector 21, the lift range gauge 22, the hook over-wind switch 23B, the pressure switches 24A and 24B and the rotation rate sensor 25 and outputs ON/OFF signals to the electromagnetic valves 6 and 44 also outputs a control signal I to the regulators 1*b* and 2*b* and the governor G. Namely, in this embodiment, when the operating lever 7 is fully engaged in a hoist-up operation, the tilt angles of the pump 1*a* and the motor 2*a* and the driving motor rotation rate n as well as the electromagnetic valves 6 and 44 are controlled so as to change the hook speed v in conformance to the characteristics shown in FIG. 5. It is to be noted that the main pump 1*a* is also connected to another actuator 46 (e.g., for traveling or swiveling) via a control valve 45.

In FIG. 10, if an affirmative decision is made in step S1, the operation proceeds to step S41 to output an ON signal to the electromagnetic valve 44 before proceeding to sequentially implement the processing in step S2, step S3 and step S4. If an affirmative decision is made in step S4, the operation proceeds to step S42 to output an OFF signal to the electromagnetic valve 44, and then the operation proceeds to step S11 before a return. If, on the other hand, a negative decision is made in step S4 and a negative decision is also made in step S5, the operation proceeds to step S50 to execute subroutine processing of speed reduction control which is to be detailed later before a return. If an affirmative decision is made in step S5, the operation proceeds to steps S6 and S7, and then the operation proceeds to step S43 in which individual command values currently set for the regulators 1*b* and 2*b* and the governor G are stored in memory before making a return. If a negative decision is made in step S1 and an affirmative decision is made in step S12, the operation proceeds to step S44 to reset the speed reduction control processing in step S50 and the command values stored in memory in step S43 are output to the regulators 1*b* and 2*b* and the governor G before proceeding to step S7.

Figure 11:
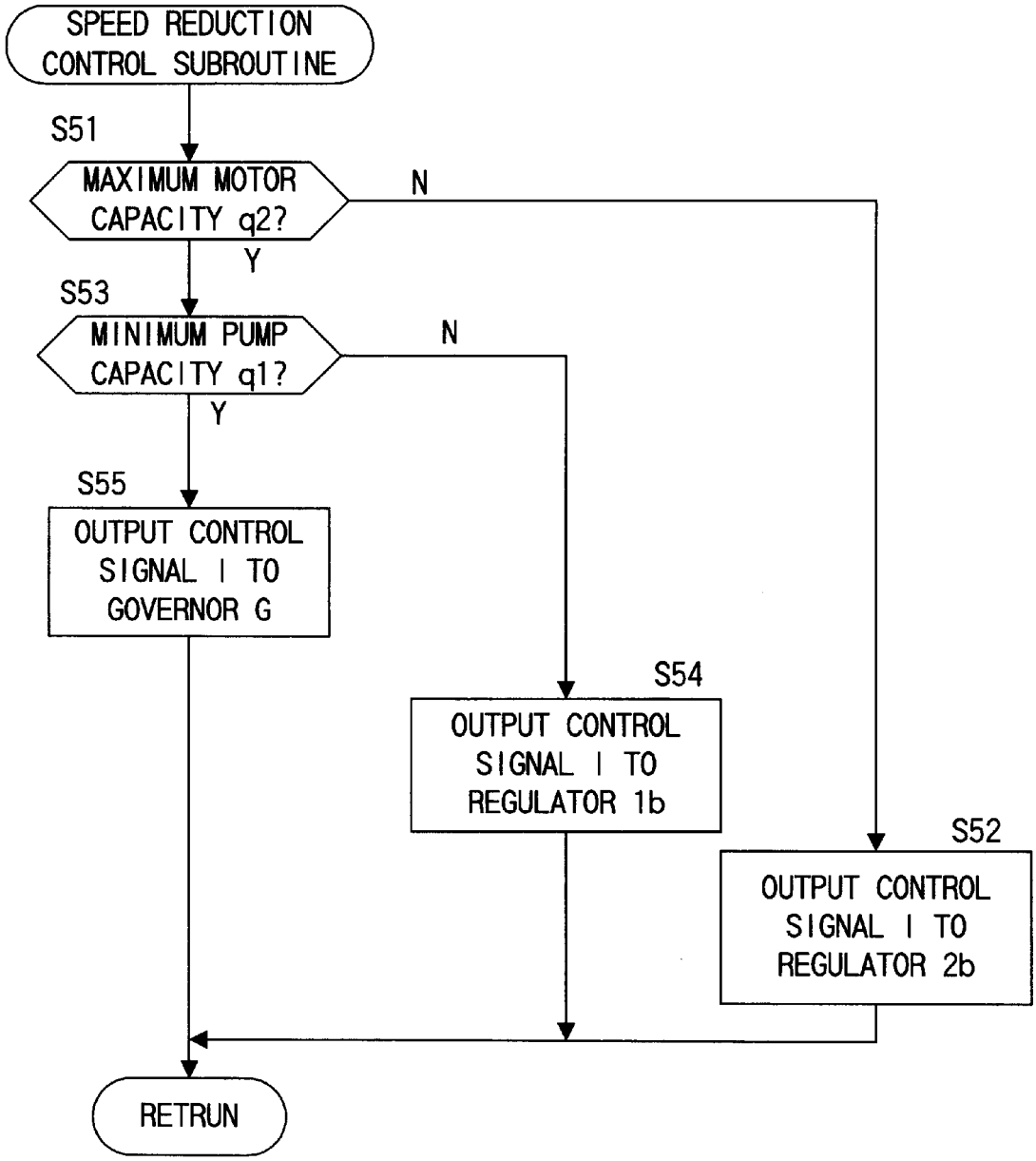
FIG. 11 is a flowchart of the speed reduction control processing which is part of the processing shown in FIG. 10 implemented by the controller.

Next, the speed reduction control processing executed in step S50 is explained. FIG. 11 is a flowchart of the subroutine processing implemented to achieve the speed is reduction control in step S50. Under normal circumstances, the motor capacity q2, the pump capacity q1, the driving motor rotation rate n and the motor rotation rate N achieve the following correlation.

$$q1 \cdot n / q2 \propto N \ldots \quad \text{(II)}$$

Figure 12:
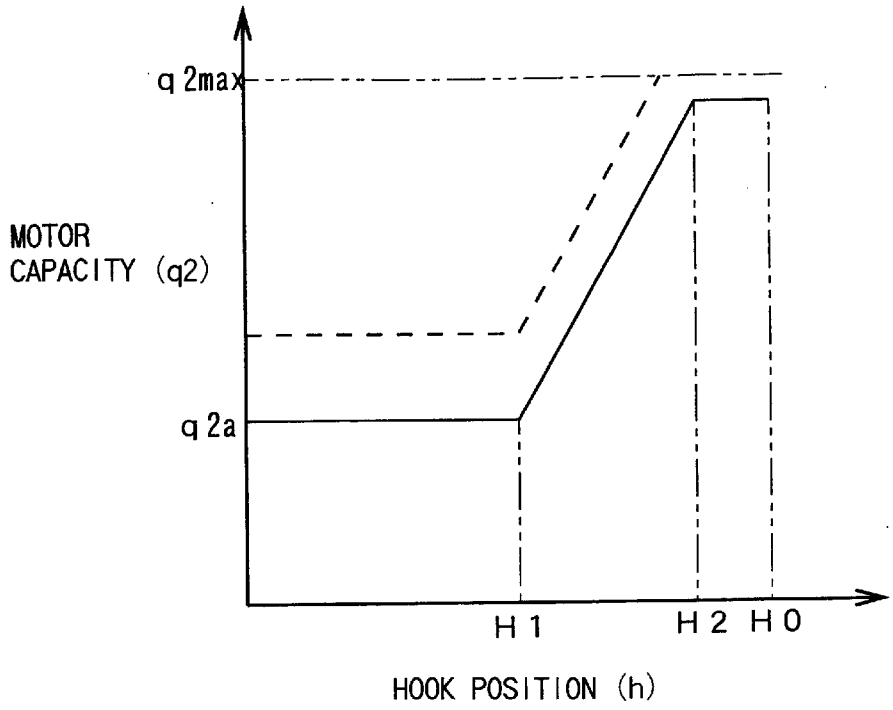
FIG. 12 shows the relationship of the motor capacity to the hook position achieved in the winch over-winding prevention apparatus in the third embodiment of the present invention.
Figure 13:
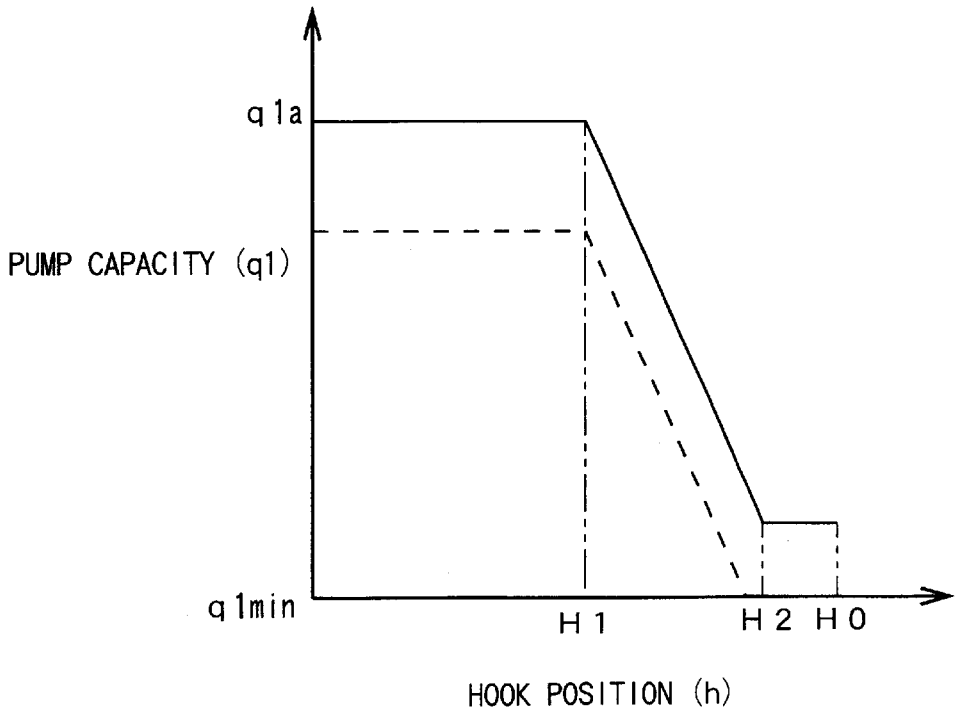
FIG. 13 shows the relationship of the pump capacity to the hook position in the winch over-winding prevention apparatus in the third embodiment of the present invention.

Thus, even when the operating lever 7 is fully engaged in a hoist-up operation, speed reduction control can be implemented on the motor rotation rate N by controlling one of the pump capacity q1, the motor capacity q2 and the driving motor rotation rate n. In this embodiment, a decision is made first in step S51 as to whether or not the motor capacity q2 of the hydraulic motor 2 is at its maximum q2max as shown in FIG. 11. If a negative decision is made in step S51, the operation proceeds to step S52 in which the motor capacity q2 is controlled by outputting a control signal I to the regulator 2*b* so that the hook speed v achieves characteristics similar to those shown in FIG. 5 before the operation makes a return. In this case, the hook position h and the motor capacity q2 achieve the relationship shown in FIG. 12 and the motor capacity q2 increases as the hook position h rises. When the motor capacity q2 reaches its maximum q2max (as indicated by the dotted line in FIG. 12), an affirmative decision is made in step S51 and the operation proceeds to step S53 to make a decision as to whether or not the pump capacity q1 of the main pump 1 is at its minimum q1min. If a negative decision is made in step S53, the operation proceeds to step S54 to output the control signal I to the regulator 1*b* to control the pump capacity q1 before making a return. In this case, the hook position h and the pump capacity q1 achieve the relationship shown in FIG. 13, and the pump capacity q1 decreases as the hook position h rises.

Figure 14:
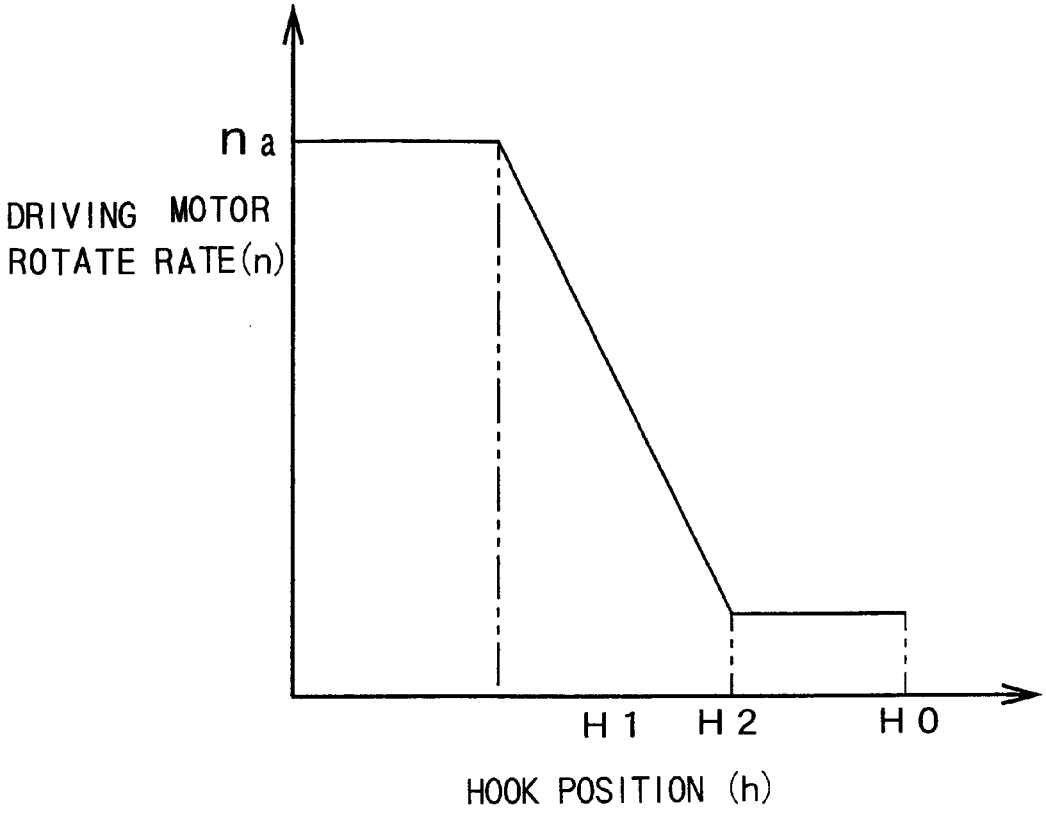
FIG. 14 shows the relationship of the drive motor rotation rate to the hook position in the winch over-winding prevention apparatus in the third embodiment of the present invention.

When the pump capacity q1 reaches its minimum q1min (as indicated by the dotted line in FIG. 13), an affirmative decision is made in step S53 and the operation proceeds to step S55 to output the control signal I to the governor G to control the driving motor rotation rate n before making a return. At this point, the hook position h and the driving motor rotation rate n achieve the relationship shown in FIG. 14, and the driving motor rotation rate n is lowered as the hook position h rises. It is to be noted that the motor capacity q2 is determined by factoring in the driving motor rotation rate n and the pump capacity q1 so that a desired speed is achieved in step S52 as well. The same processing principle applies to step S54 and step S55.

Since the hydraulic pump 1*a* is also connected to the other actuator 46, it must be ensured that the operation of the other actuator 46 is not affected by the speed reduction control. Accordingly, the control on the motor capacity q2 is implemented first (step S52) and then control of the pump capacity q1 and the driving motor rotation rate N is implemented (step S54 and step S55) in the embodiment. It is to be noted that when the operating lever 7 is engaged in a hoist-down operation, the speed reduction control in step S50 is reset (step S44) and the motor capacity q2, the pump capacity q1 and the driving motor rotation rate n are respectively controlled to achieve the pre-speed reduction control values (q2*a*, q1*a* and na in FIGS. 12~14). As a result, the hook F can be hoisted down during a hoist-down operation without implementing speed reduction control.

Fourth Embodiment

Figure 15:
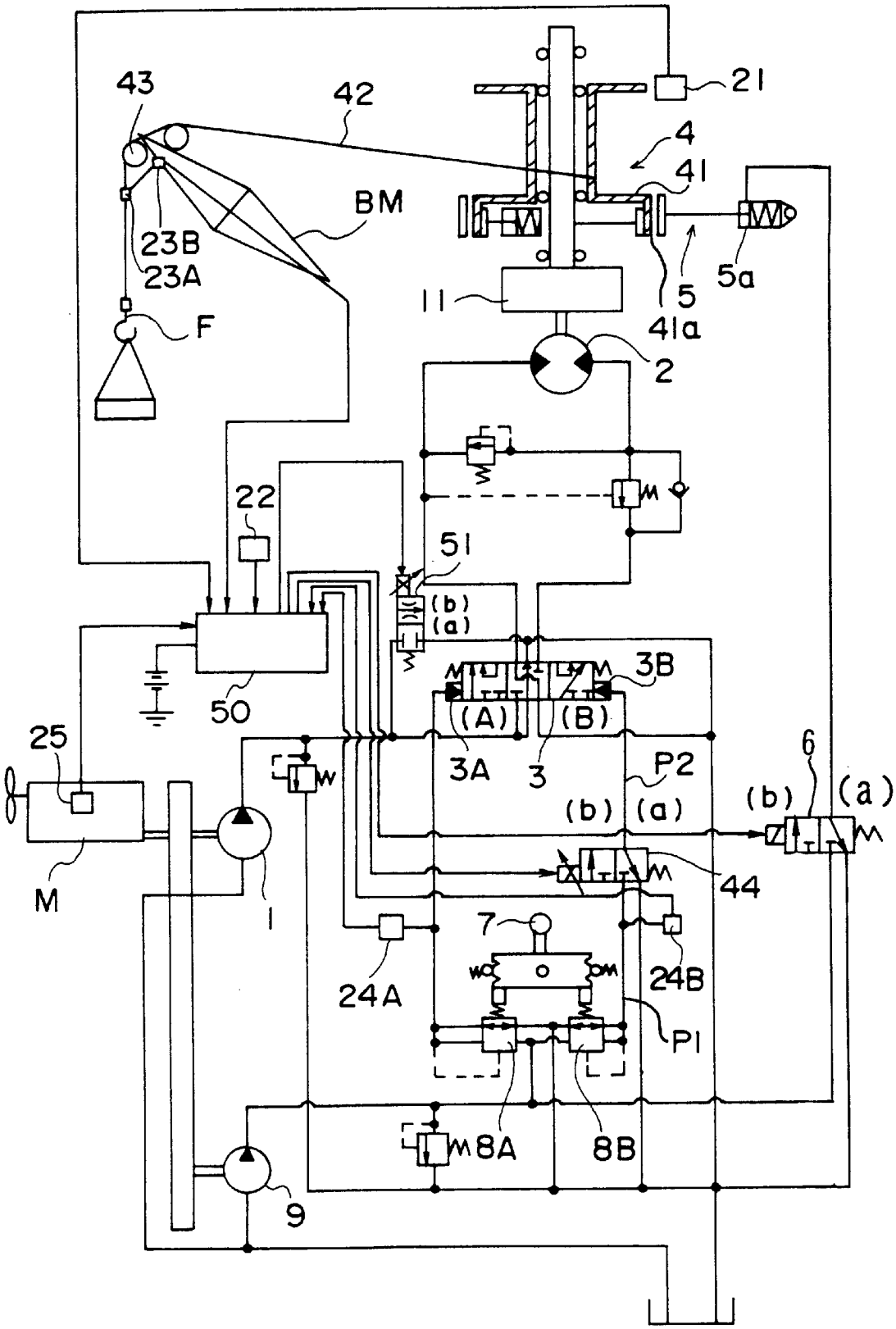
FIG. 15 is a hydraulic circuit diagram illustrating the structure of the winch over-winding prevention apparatus in a fourth embodiment of the present invention.
Figure 16:
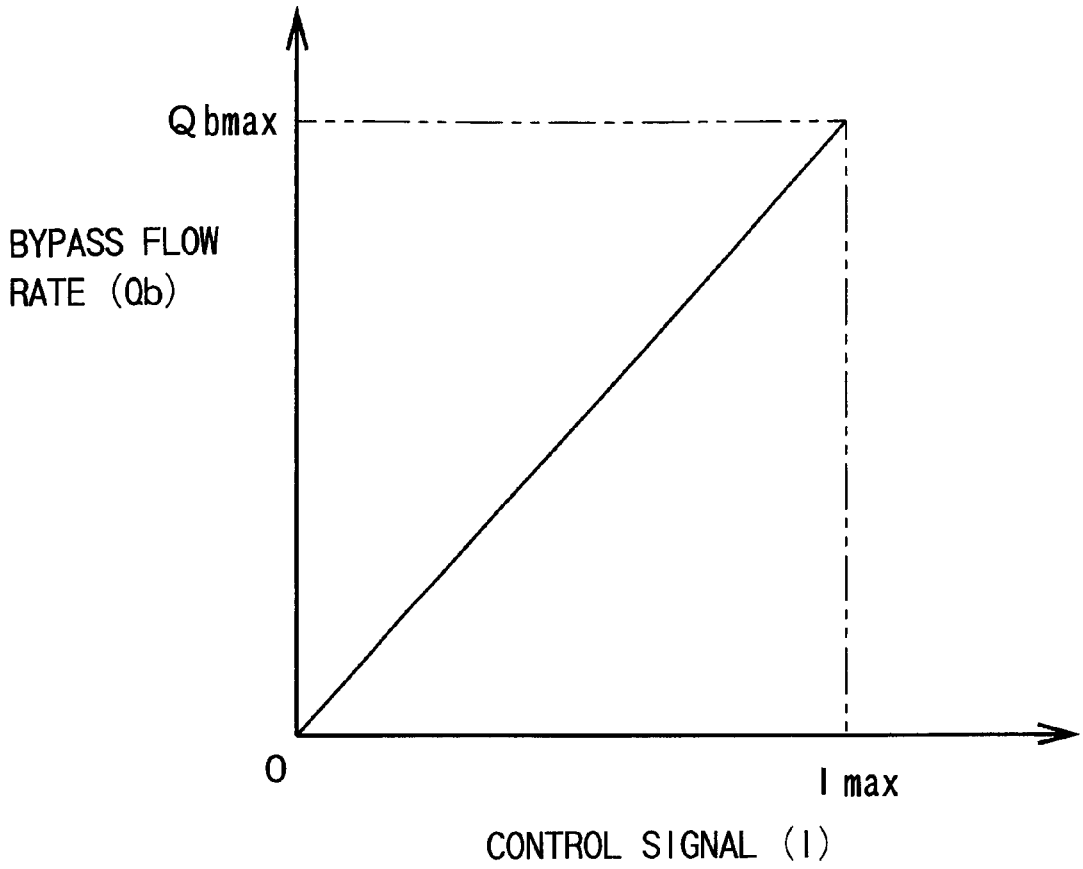
FIG. 16 shows the control characteristics (the pilot flow rate corresponding to the control signal) of the electromagnetic proportional valve in the fourth embodiment of the present invention.

FIG. 15 is a hydraulic circuit diagram illustrating the structure of the winch over-winding prevention apparatus in the fourth embodiment of the present invention. It is to be noted that the following explanation mainly focuses on the differences from the embodiments shown in FIGS. 1 and 9 by assigning the same reference numbers to identical components. In FIG. 15, an electromagnetic proportional valve 51 (a flow-regulating valve) which allows the pressure oil from the main pump 1 to divert (bypass) to a tank is connected between the main pump 1 and the control valve 3. A controller 50 executes processing which is to be detailed later by taking in signals from the rotation detector 21, the lift range gauge 22, the hook over-wind switch 23B, the pressure switches 24A and 24B and the rotation rate sensor 25, outputs ON/OFF signals to the electromagnetic valves 6 and 44 and also outputs a control signal I to the electromagnetic proportional valve 51. The bypass flow rate Qb of the pressure oil passing through the electromagnetic proportional valve 51 and the control signal achieve the relationship shown in FIG. 16. As shown in FIG. 16, when the control signal I=0, the electromagnetic proportional valve 51 is switched to the position (a) to set the bypass flow rate Qb to 0, whereas when the control signal I=Imax, the electromagnetic proportional valve 51 is switched to a position (b) and the bypass flow rate Qb is set to the maximum (=Qbmax).

Figure 17:
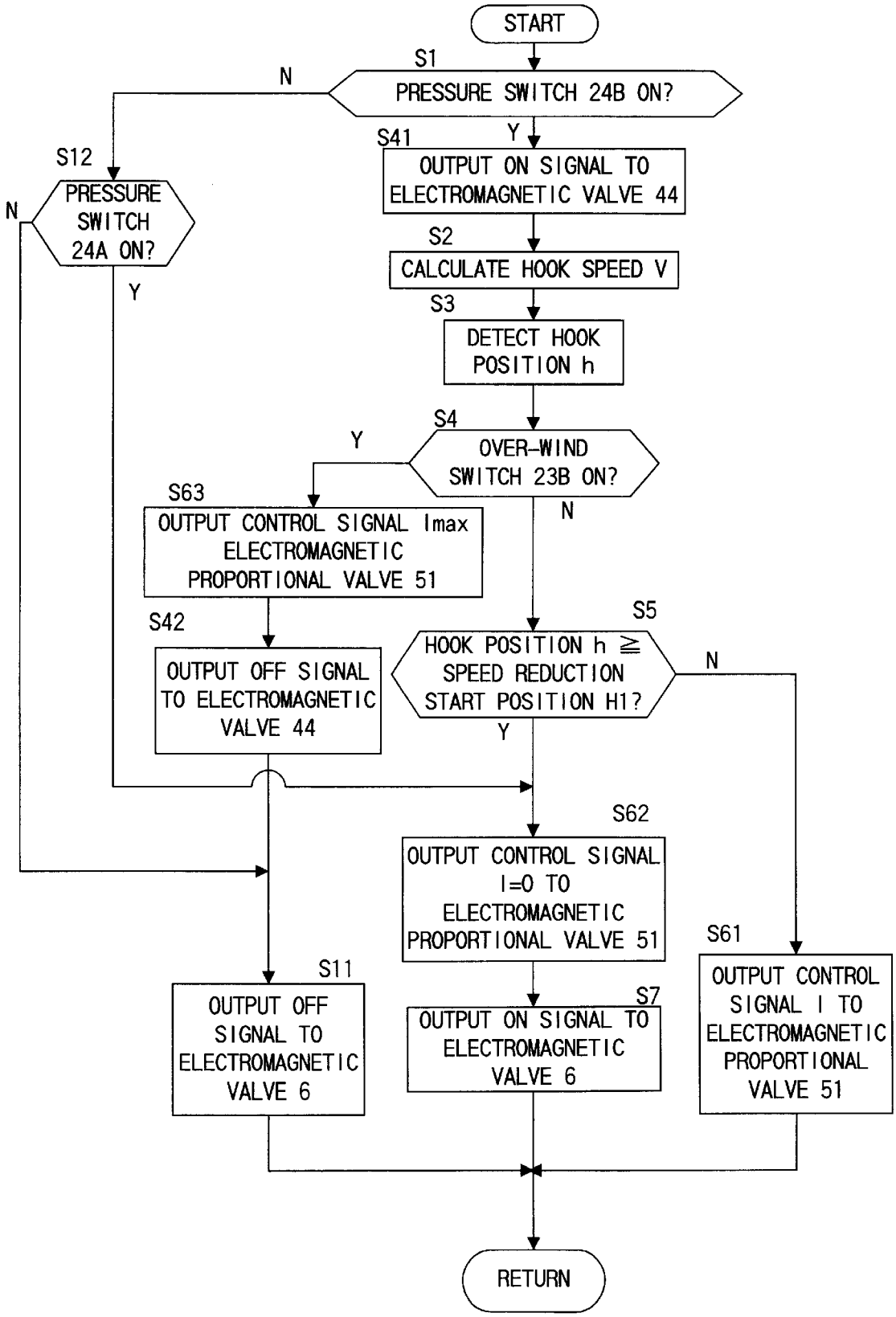
FIG. 17 is a flowchart of the processing implemented by the controller constituting the winch over-winding prevention apparatus in the fourth embodiment of the present invention.

FIG. 17 is a flowchart of the processing executed by the controller 50. It is to be noted that the same step numbers are assigned to the steps identical to those in FIG. 10 and the following explanation is given by focusing on the differences. When the hook F reaches the speed reduction start position H1 while the operating lever 7 is fully engaged in a hoist-up operation, a negative decision is made in step S5 and the operation proceeds to step S61. In step S61, processing similar to that executed in step S8 and step S9 in FIG. 4 is implemented to output a control signal I corresponding to the driving motor rotation rate n and the hook position h to the electromagnetic proportional valve 51 before making a return. In other words, the control signal I is output by gradually increasing its value as the hook F is raised to increase the bypass flow rate Qb, thereby achieving a relationship between the hook position h and the hook speed v which is similar to that shown in FIG. 5. If, on the other hand, an affirmative decision is made in step S5, the operation proceeds to step S62 in which the control signal I=0 is output to the electromagnetic proportional valve 51 to set the bypass flow rate Qb to 0, and then the operation returns to step S7 before making a return. When the hook F reaches the hook over-wind activation position H0, an affirmative decision is made in step S4 and the operation proceeds to step S63 in which the control signal Imax is output to the electromagnetic proportional valve 51 to set the bypass flow rate Qb to the maximum Qbmax. Since only a very small quantity of pressure oil passes through the control valve 3 in this state, rotation of the hydraulic motor 2 is disallowed. In addition, an OFF signal is output to the electromagnetic valve 44 in step S42. When the operating lever 7 is engaged in a hoist-down operation, an affirmative decision is made in step S12 and the operation proceeds to step S62 in which the control signal I=0 is output to the electromagnetic proportional valve 51 to set the bypass flow rate Qb to 0. As a result, the hook F can be hoisted down at a speed corresponding to the degree to which the lever is operated.

Figure 18:
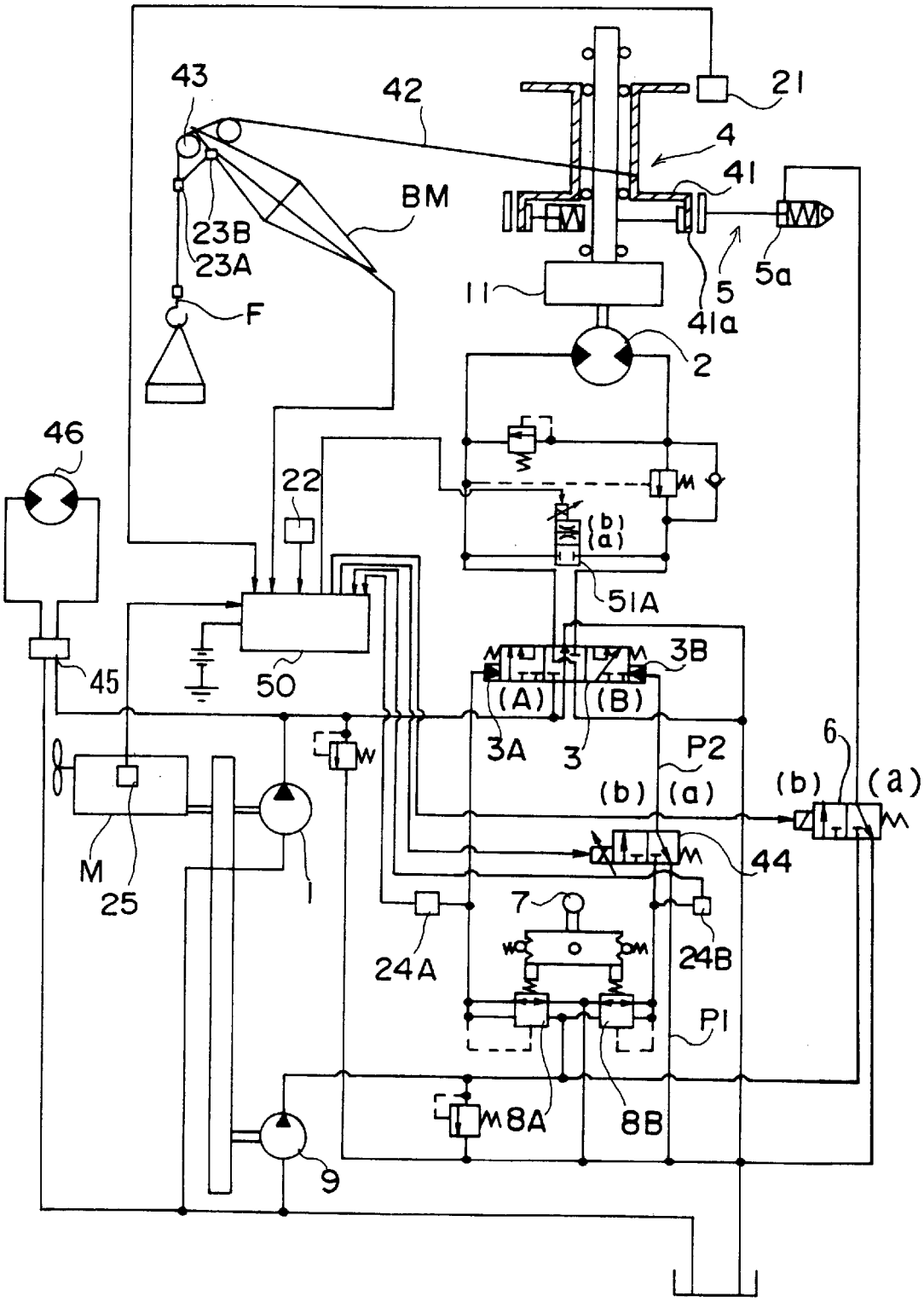
FIG. 18 is a hydraulic circuit diagram showing another structure that may be adopted in the winch over-winding prevention apparatus in the fourth embodiment of the present invention.

It is to be noted that the hydraulic circuit in FIG. 15 may adopt the structure shown in FIG. 18 instead. In FIG. 18, an electromagnetic proportional valve 51A is provided so as to communicate or block an intake/outlet port of the hydraulic motor 2, and the main pump 1 is also connected to another actuator 46 via a control valve 45. While the pressure oil from the main pump 1 is supplied to the actuator 46 via of the control valve 45 and is also supplied to the hydraulic motor 2 via the control valve 3, some of the pressure oil having passed through the control valve 3 bypasses the hydraulic motor 2 in correspondence to the degree of openness of the electromagnetic proportional valve 51A, and thus, the rotation rate of the hydraulic motor 2 is controlled. In this case, the quantity of the pressure oil supplied to the control valve 3 is not restricted in conformance to the degree of openness of the electromagnetic proportional valve 51A. Therefore, adverse effects such as loss of speed do not manifest in the other actuator 46.

Figure 19:
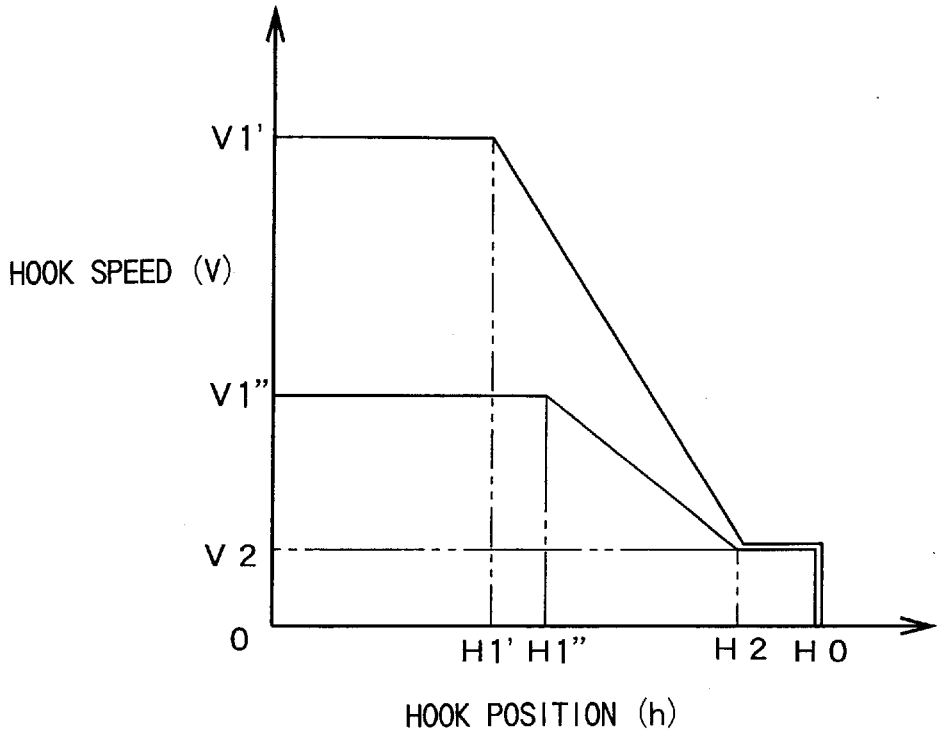
FIG. 19 shows other operating characteristics (the relationship between the hook position and the hook speed) that may be achieved in the winch over-winding prevention apparatus in the embodiment of the present invention.
Figure 20:
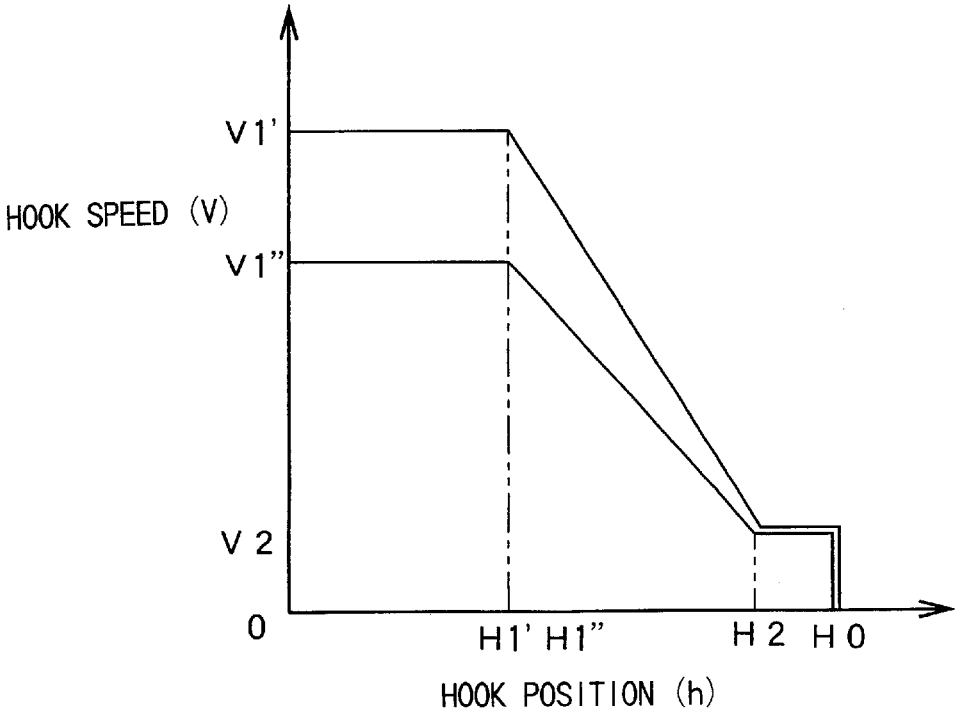
FIG. 20 shows other operating characteristics (the relationship between the hook position and the hook speed) that may be achieved in the winch over-winding prevention apparatus in the embodiment of the present invention.
Figure 21:
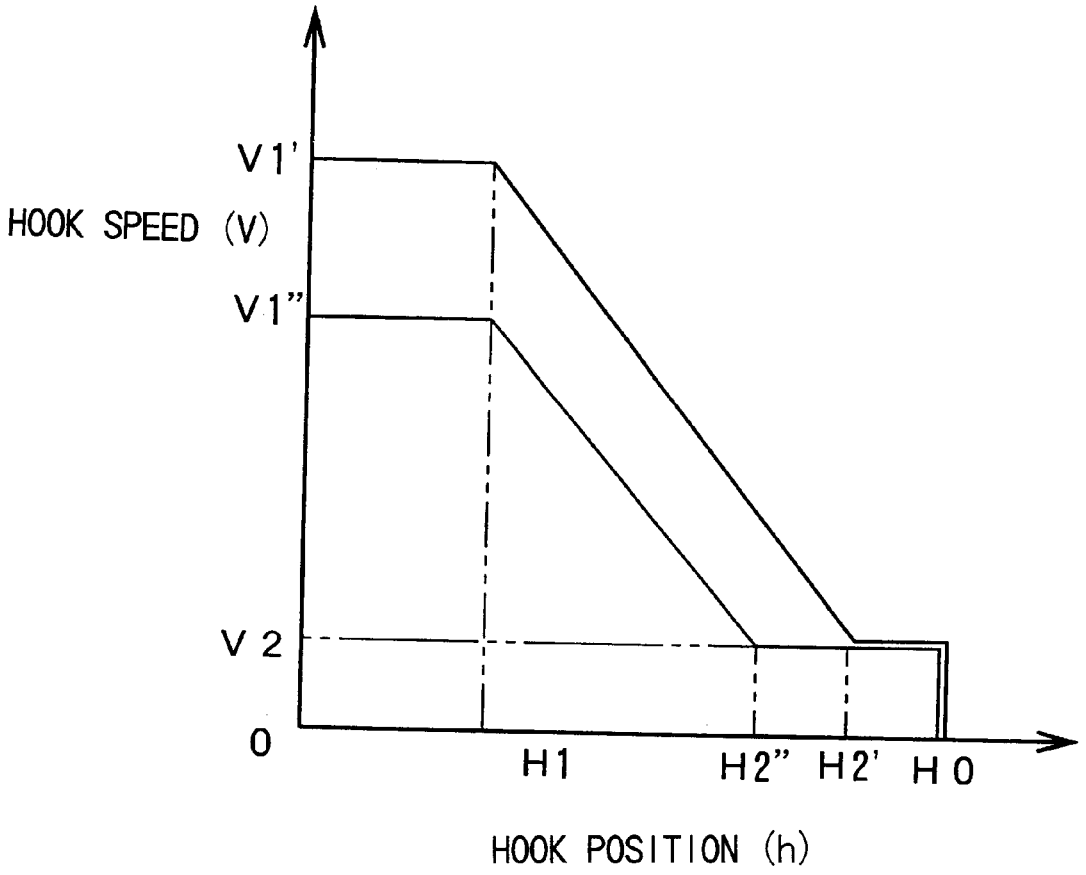
FIG. 21 shows other operating characteristics (the relationship between the hook position and the hook speed) that may be achieved in the winch over-winding prevention apparatus in the embodiment of the present invention.

It is to be noted that a hook speed reduction pattern (the speed reduction characteristics manifesting in the block between the speed reduction start position H1 and the speed reduction end position H2) in the embodiment simply represents an example and the present invention is not limited to it this example. Namely, while the deceleration during the hook upward hoist motion is constant as shown in FIG. 5 in the embodiment, the deceleration may be varied in correspondence to the hook speed v1' or v1" as shown in FIG. 19. In addition, while the speed reduction start position is set to H1' or H1" in correspondence to the hook speed v1' or v1", the speed reduction start position H1 may remain constant regardless of the hoist speed v, as shown in FIG. 20. In such a case, a weight and a switch for speed reduction start may be provided under the weight 23A and the switch 23B for the hook over-winding prevention apparatus to allow a decision to be made with regard to a speed reduction start in conformance to their operating states. Furthermore, the speed reduction end position H2 may be varied in correspondence to the hook speed as shown in FIG. 21.

While the hook speed v changes in correspondence to the driving motor rotation rate n on an assumption that the operating lever 7 is operated to a constant degree (full operation) in the embodiments, the hook speed v may change in correspondence to the degree to which the operating lever 7 is operated by taking into account the degree of operation of the operating lever 7 as a factor. Moreover, while the lift range gauge 22 is utilized to detect the hook position h in the embodiments, the present invention is not limited by this example and another type of detector (e.g., a laser detector or an ultrasound detector) may be employed to detect the distance h between the hook F and the weight 23A.

Fifth Embodiment

Since the winch over-winding prevention apparatus in the fifth embodiment assumes a structure identical to that adopted in the first embodiment illustrated in FIG. 1, its block diagram and an explanation of its components are omitted. Accordingly, the following explanation on its structure is given in reference to FIG. 1.

In the first embodiment, the hoist speed v of the hook F is detected, the speed reduction start position H1 is calculated in correspondence to the hoist speed v and the control signal I output to the electromagnetic proportional valve 10 is controlled so as to ensure that the hoist speed v is reduced at a specific deceleration rate starting at the calculated speed reduction start position H1. However, in the fifth embodiment, a speed reduction start position H1' corresponding to the maximum hook speed vmax is determined in advance, and when the hook F reaches the position H1', a control signal I which will achieve specific speed reduction characteristics is output to the electromagnetic proportional valve 10 regardless of the actual speed v of the hook F.

Figure 22:
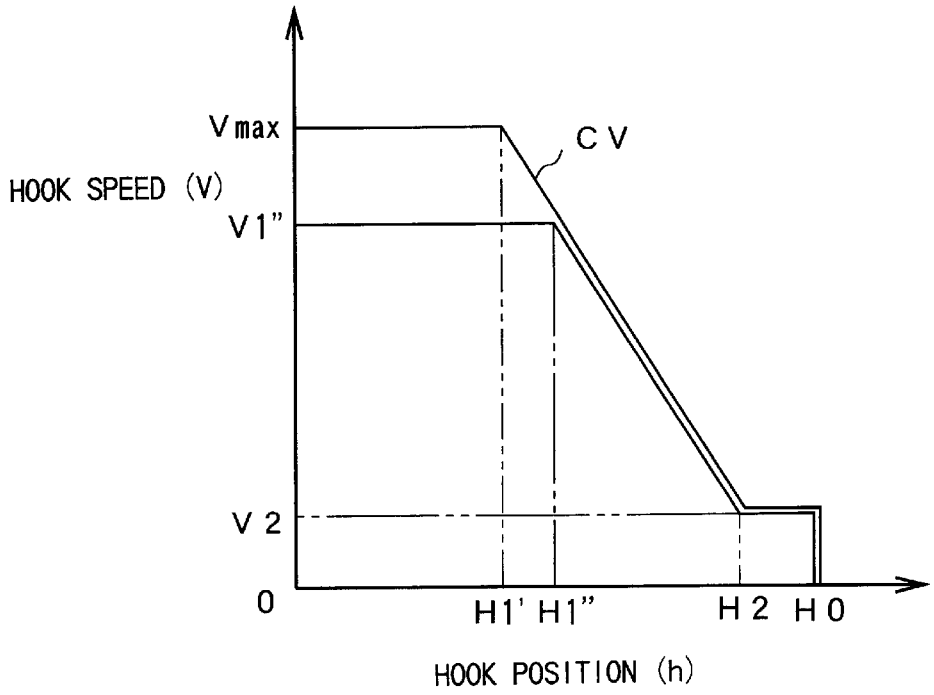
FIG. 22 shows the operating characteristics (the relationship between the hook position and the hook speed) achieved in the winch over-winding prevention apparatus in a fifth embodiment of the present invention.
Figure 23:
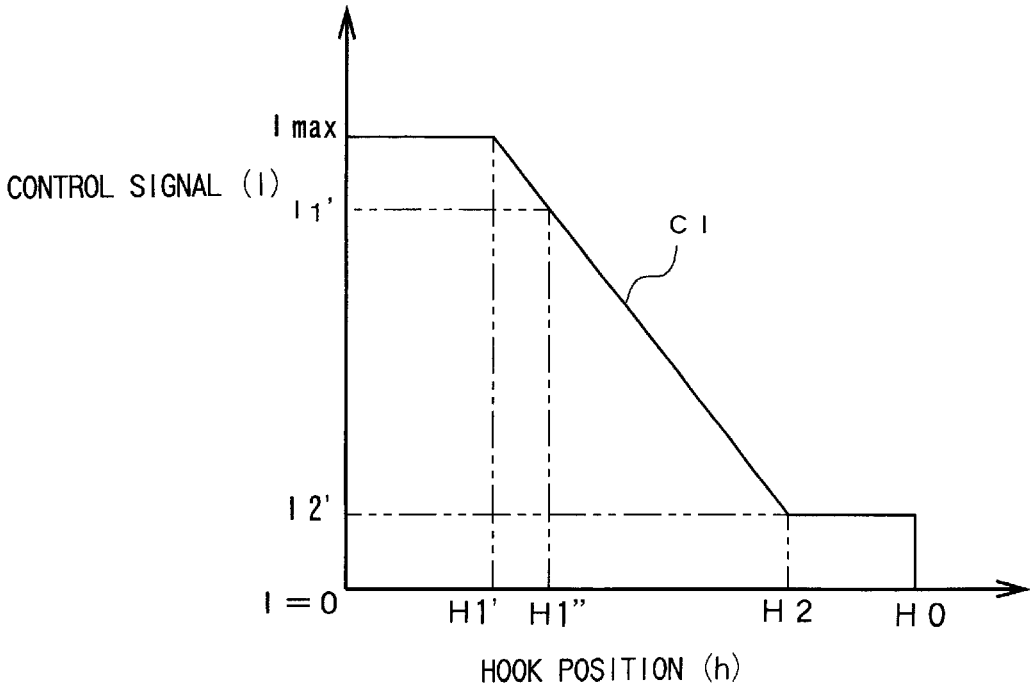
FIG. 23 shows the control signal output in correspondence to the hook position in the winch over-winding prevention apparatus in the fifth embodiment of the present invention.

Namely, as shown in FIG. 22, hook speed characteristics CV whereby the speed reduction starts at the hook position H1' while the hook speed is at the maximum vmax and the hook speed is stabilized at a constant speed v2 at the hook position H2 are determined in advance. FIG. 23 shows characteristics CI of the control signal I output to the electromagnetic proportional valve 10 to realize such hook speed characteristics CV. In the fifth embodiment, the hook position is detected, the control signal I corresponding to the detection value is calculated in conformance to the characteristics CI in FIG. 23 regardless of the actual speed v of the hook F and the control signal resulting from the calculation is output to the electromagnetic proportional valve 10. Thus, when the hook speed is at v1", for instance, the value of the control signal I starts to decrease along the characteristics curve CI once the hook reaches the position H1' and, as a result, the electromagnetic proportional valve 10 is switched to that position (a) thereby reducing the degree of valve openness. However, since the actual speed v of the hook F is lower than the hook speed defined in conformance to the hook speed characteristics CV until the hook position reaches H1", the hook speed v1" is not reduced. Only when the hook reaches the position H1" and the control signal achieves a value I1', is the hook speed v1" reduced in conformance to the characteristics CV in FIG. 22.

Figure 24:
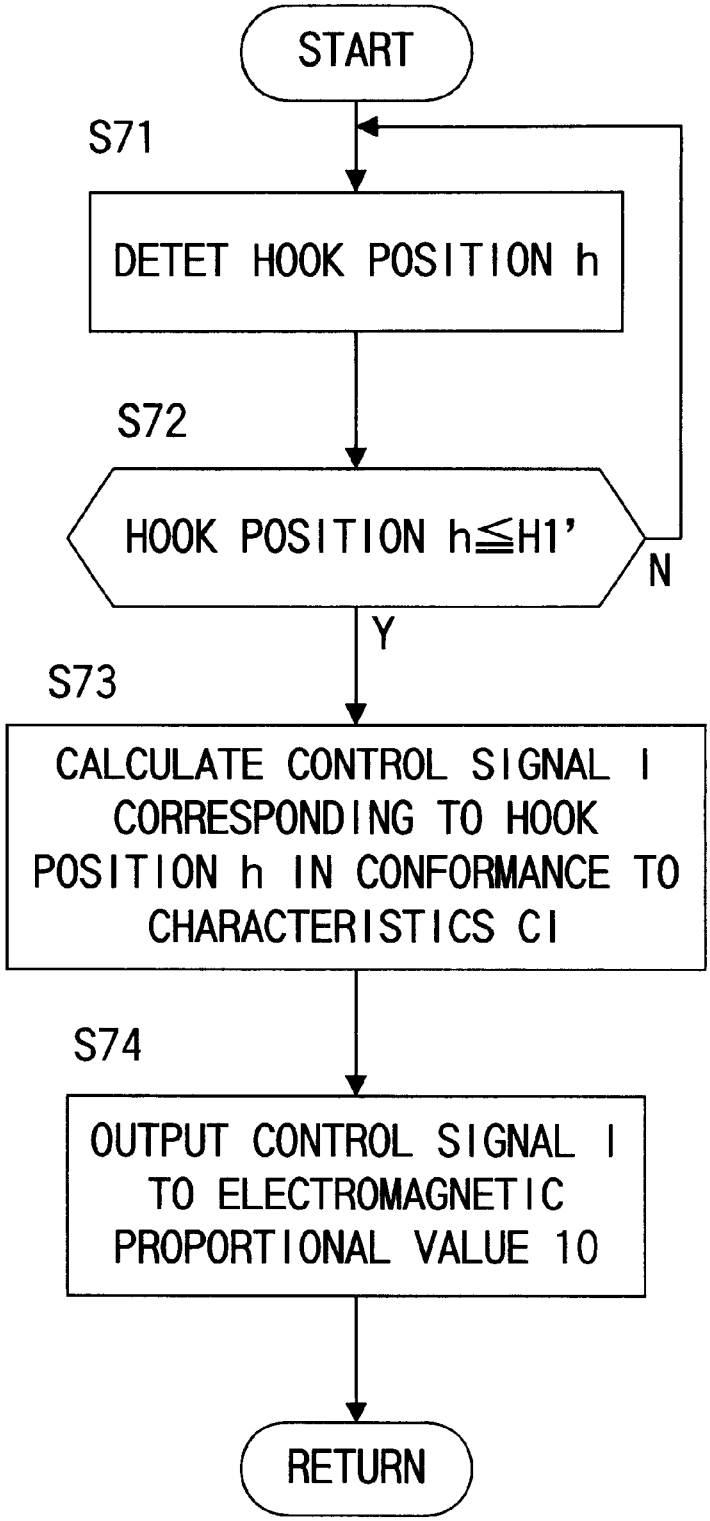
FIG. 24 is a flowchart of the processing implemented by the controller constituting the winch over-winding prevention apparatus in the fifth embodiment of the present invention.

FIG. 24 is a flowchart of the processing implemented by the controller 20 constituting the winch over-winding prevention apparatus in the fifth embodiment, and the degree to which the pressure is reduced at the electromagnetic proportional valve 10 is controlled as shown in the flowchart. In FIG. 24, the hook position h is detected by using the lift range gauge 22 in step S71. In the following step S72, a decision is made as to whether or not the hook position has reached the speed reduction start position H1' corresponding to the maximum hook speed vmax and, if an affirmative decision is made, the operation proceeds to step S73, whereas if a negative decision is made, the operation returns to step S71. In step S73, a control signal I corresponding to the hook position is calculated in conformance to the specific characteristics CI shown in FIG. 23, and in the following step S74, the control signal I is output to the electromagnetic proportional valve 10 before the operation makes a return.

As described above, in the fifth embodiment, the speed reduction start position H1' corresponding to the maximum hook speed vmax is determined in advance, and when the hook reaches the position H1', the control signal I which will achieve the specific speed reduction characteristics is output to the electromagnetic proportional valve 10 regardless of the actual speed v of the hook F. As a result, it is not necessary to calculate the speed reduction start position by detecting the hook speed, to achieve better response and simplification of the structure.

What is claimed is:

1. A winch over-winding prevention apparatus for a crane, comprising:

a winch drum that is driven for up/down hoist in response to a command issued through an operating lever;

a stop switch that is activated when a suspended object that is raised or lowered as a hoisting cable is wound around said winch drum is further taken up or fed out is hoisted up to a predetermined stop position;

a stop device that stops drive of said winch drum when said stop switch is activated;

a speed detection device that detects a hoist speed of the suspended object;

a speed reduction device that reduces a drive speed of said winch drum once the suspended object reaches a predetermined speed reduction start position; and a speed reduction control device that calculates a deceleration rate of said winch drum in correspondence to the hoist speed of the suspended object detected by said speed detection device and controls drive of said speed reduction device in response to a speed reduction command corresponding to the deceleration rate, wherein:

said speed reduction control device calculates the deceleration rate so as to set the drive speed of said winch drum to a predetermined speed at a speed reduction end position set at a predetermined distance from the predetermined stop position, and controls the drive of said speed reduction device by outputting a speed reduction command corresponding to the deceleration rate until the suspended object having departed the speed reduction start position reaches the speed reduction end position and outputting a constant speed command corresponding to the predetermined speed until the suspended object having departed the speed reduction end position reaches the stop position.

2. A winch over-winding prevention apparatus for a crane according to claim 1, wherein:

said speed reduction device controls a physical quantity bearing a correlation to a motor rotation rate of a hydraulic motor that drives said winch drum; and said speed reduction control device resets an output of said speed reduction command when said operating lever is driven for a hoist-down.

3. A winch over-winding prevention apparatus for a crane, comprising:

a winch drum that is driven for up/down hoist in response to a command issued through an operating lever;

a stop switch that is activated when a suspended object that is raised or lowered as a hoisting cable is wound around said winch drum is further taken up or fed out is hoisted up to a predetermined stop position; and a stop device that stops drive of said winch drum when said stop switch is activated, further comprising:

a speed detection device that detects a hoist speed of the suspended object;

a position detection device that outputs a signal corresponding to a raised or lowered position of the suspended object;

a speed reduction device that reduces a drive speed of said winch drum; and a speed reduction control device that calculates a speed reduction start position in correspondence to the hoist speed of the suspended object detected by said speed detection device and controls drive of said speed reduction device by outputting a speed reduction command corresponding to a predetermined deceleration rate when the suspended object is detected to have reached the speed reduction start position through the signal output from said position detection device, wherein:

said speed reduction control device calculates the speed reduction start position so as to set the drive speed of said winch drum to a predetermined speed at a speed reduction end position set at a predetermined distance from the predetermined stop position when the drive speed of said winch drum is reduced at the predetermined deceleration rate, and controls the drive of said speed reduction device by outputting a speed reduction command corresponding to the predetermined deceleration rate until the suspended object having departed the speed reduction start position reaches the speed reduction end position and outputting a constant speed command corresponding to the predetermined speed until the suspended object having departed the speed reduction end position reaches the stop position.

4. A winch over-winding prevention apparatus for a crane according to claim 3, wherein:

said speed reduction control device also calculates a deceleration rate of said winch drum in correspondence to the hoist speed of the suspended object detected by said speed detection device instead of using the predetermined deceleration and controls the drive of said speed reduction device by outputting a speed reduction command corresponding to the deceleration rate when the suspended object is detected to have reached the speed reduction start position through the signal output by said position detection device.

5. A winch over-winding prevention apparatus for a crane according to claim 3, wherein:

said speed reduction device controls a physical quantity bearing a correlation to a motor rotation rate of a hydraulic motor that drives said winch drum; and said speed reduction control device resets an output of said speed reduction command when said operating lever is driven for a hoist-down.

6. A winch over-winding prevention apparatus for a crane, comprising:

a winch drum that is driven for up/down hoist in response to a command issued through an operating lever;

a stop switch which is activated when a suspended object that is raised or lowered as a hoisting cable is wound around said winch drum is further taken up or fed out is hoisted up to a predetermined stop position; and a stop device that stops drive of said winch drum when said stop switch is activated, further comprising:

a speed reduction device that reduces a drive speed of said winch drum once the suspended object reaches a predetermined speed reduction start position; and a speed reduction control device that controls drive of said speed reduction device by outputting a speed reduction command until the suspended object having departed the speed reduction start position reaches a speed reduction end position set a predetermined distance from the predetermined stop position and outputting a constant speed command until the suspended object having departed the speed reduction end position reaches the stop position.

7. A winch over-winding prevention apparatus for a crane, comprising:

a winch drum that is driven for up/down hoist in response to a command issued through an operating lever;

a stop switch that is activated when a suspended object that is raised or lowered as a hoisting cable is wound around said winch drum is further taken up or fed out is hoisted up to a predetermined stop position; and a stop device that stops drive of said winch drum when said stop switch is activated, further comprising:

a speed reduction device that reduces a drive speed of said winch drum once the suspended object reaches a predetermined speed reduction start position;

a speed reduction control device that controls drive of said speed reduction device by outputting a speed reduction command until the suspended object having departed the speed reduction start position reaches a predetermined speed reduction end position set at a predetermined distance from the predetermined stop position and outputting a constant speed command until the suspended object having departed the speed reduction end position reaches the stop position; and a brake device that applies brakes on said winch drum after the drive of said winch drum is stopped by said stop device.

8. A winch over-winding prevention apparatus for a crane according to claim 7, wherein:

said speed reduction control device calculates a deceleration rate of said winch drum in correspondence to the hoist speed of the suspended object detected by said speed detection device and controls the drive of said speed reduction device in response to a speed reduction command corresponding to the deceleration rate.

9. A winch over-winding prevention apparatus for a crane according to claim 7, further comprising:

a position detection device that outputs a signal corresponding to a raised or lowered position of the suspended object, wherein:

said speed reduction control device calculates a speed reduction start position in correspondence to the hoist speed of the suspended object detected by said speed detection device and controls the drive of said speed reduction device by outputting a speed reduction command corresponding to a predetermined deceleration rate when the suspended object to have reached the speed reduction start position through the signal output by said position detection device.

10. A winch over-winding prevention apparatus for a crane according to claim 7, wherein:

said brake device is a negative brake device in which a break is released when said operating lever is operated and is controlled to apply brakes on said winch drum after the drive of said winch drum is stopped by said stop device.

11. A winch over-winding prevention apparatus for a crane, comprising:

a winch drum that is driven for up/down hoist in response to a command issued through an operating lever;

a stop switch that is activated when a suspended object that is raised or lowered as a hoisting cable wound around said winch drum is further taken up or fed out is hoisted up to a predetermined stop position;

a stop device that stops drive of said winch drum when said stop switch is activated; and a speed control device that controls a drive speed of said winch drum in response to a command issued through said operating lever, further comprising:

a maximum speed limit device that limits a maximum speed at which said winch drum is driven, wherein: said maximum speed limit device limits the maximum speed at which said winch drum is driven in conformance to characteristics whereby the drive speed is reduced at a predetermined deceleration rate starting at a predetermined limit start position, the characteristics being set so as to set the limited maximum speed of said winch drum to a predetermined speed at a predetermined speed reduction end position.

12. A winch over-winding prevention apparatus for a crane, according to claim 11, wherein:

said end position is set at a predetermined distance from said predetermined stop position, and said maximum speed limit device limits the maximum speed of said winch drum in conformance to the characteristics thus set until the suspended object having departed the predetermined limit start position reaches the speed reduction end position and limits the maximum speed at which said winch drum is driven to the predetermined speed until the suspended object having departed the speed reduction end position reaches the stop position.

* * * * *

UNITED STATES PATENT AND TRADEMARK OFFICE

CERTIFICATE OF CORRECTION

PATENT NO. : 6,644,629 B1
DATED : November 11, 2003
INVENTOR(S) : Higashi et al.

It is certified that error appears in the above-identified patent and that said Letters Patent is hereby corrected as shown below:

Title page,
Item [60],

"Related U.S. Application Data
[60] Provisional application No. 60/108,080 filed on November 12, 1998." should be deleted.

Signed and Sealed this

Twentieth Day of April, 2004

JON W. DUDAS
*Acting Director of the United States Patent and Trademark Office*